US006097357A

United States Patent [19]

Shinoda et al.

[11] Patent Number: 6,097,357

[45] **Date of Patent: *Aug. 1, 2000**

[54] FULL COLOR SURFACE DISCHARGE TYPE PLASMA DISPLAY DEVICE

[75] Inventors: Tsutae Shinoda; Noriyuki Awaji; Shinji Kanagu; Tatsutoshi Kanae; Masayuki Wakitani; Toshiyuki Nanto; Mamaru Miyahara, all of Kawasaki, Japan

[73] Assignee: Fujitsu Limited, Kawasaki, Japan

[ * ] Notice: This patent is subject to a terminal disclaimer.

[21] Appl. No.: 08/888,442

[22] Filed: Jul. 3, 1997

Related U.S. Application Data

[63] Continuation-in-part of application No. 08/800,759, Feb. 13, 1997, and a continuation of application No. 08/469,815, Jun. 6, 1995, Pat. No. 5,661,500, and a continuation of application No. 08/458,288, Jun. 2, 1995, Pat. No. 5,674,553, and a division of application No. 08/010,169, Jan. 28, 1993, abandoned, and a continuation-in-part of application No. 08/674,161, Jul. 1, 1996, Pat. No. 5,724,054, which is a division of application No. 08/405,920, Mar. 16, 1995, Pat. No. 5,541,618, which is a continuation of application No. 08/181,959, Jan. 18, 1994, abandoned, which is a continuation of application No. 07/799,255, Nov. 27, 1991, abandoned.

[30] Foreign Application Priority Data

| | | | |
|---|---|---|---|
| Nov. 28, 1990 | [JP] | Japan | 2-331589 |
| Jan. 28, 1992 | [JP] | Japan | 4-012976 |
| Apr. 16, 1992 | [JP] | Japan | 4-096203 |
| Apr. 24, 1992 | [JP] | Japan | 4-106953 |
| Apr. 24, 1992 | [JP] | Japan | 4-106955 |
| Apr. 30, 1992 | [JP] | Japan | 4-110921 |

[51] Int. Cl.[7] ..... G09G 3/28

[52] U.S. Cl. ..... 345/63; 345/60; 313/485; 313/585

[58] Field of Search ..... 345/60, 63, 68, 345/87, 62, 65, 66, 67, 78, 88; 313/584, 585, 586, 484, 485, 491, 492, 169.1, 169.3, 169.4

[56] References Cited

U.S. PATENT DOCUMENTS 3,886,403 5/1975 Owaki et al. ..... 315/169 R (List continued on next page.)

FOREIGN PATENT DOCUMENTS 0 157 248 10/1985 European Pat. Off. .

(List continued on next page.)

OTHER PUBLICATIONS

Shinoda et al., "Low–Voltage Operated AC Plasma–Display Panels," *IEEE Transactions on Electron Devices*, vol. ED–26, No. 8, Aug. 1979, pp. 1163–1167.

(List continued on next page.)

*Primary Examiner*—Dennis-Doon Chow
*Attorney, Agent, or Firm*—Staas & Halsey LLP

[57] ABSTRACT

A matrix display panel of first and second substrates having respective main surfaces in parallel and opposed relationship has parallel address electrodes and respective continuous phosphor stripes arranged within corresponding elongated cavities on the main surface of the first substrate, extending in a first direction. Display electrodes on the main surface of the second substrate extend in a second, transverse direction and cross the address electrodes and respective phosphor stripes, each display electrode defining a display line of pixels. A driving system drives the panel in accordance with color image data defining successive color images to be displayed in respective, successive image frames, the color image data of each frame defining respective relative brightness gradation levels and comprising a plurality of subframes wherein lines are concurrently activated in each subframe and each subframe includes an addressing period for addressing a pixel by selectively applying a write pulse to each selected one of the pixels, the write pulse forming a memory medium in a selected one of all the pixels, a display period for lighting said addressed pixel by a concurrent application of sustain pulses to all the pixels, each subframe being allocated with a predetermined number of the sustain pulses so as to weight a gradation to said respective subframe, wherein a gradation of visual brightness of the lit pixel is determined by selectively operating the subframe for each of the pixels for each frame.

37 Claims, 18 Drawing Sheets

U.S. PATENT DOCUMENTS

| | | | |
|---|---|---|---|
| 3,906,290 | 9/1975 | Kurahashi et al. | 315/169 R |
| 3,972,040 | 7/1976 | Hilsum et al. | 340/324 M |
| 4,005,402 | 1/1977 | Amano | 340/324 M |
| 4,249,105 | 2/1981 | Kamagaya et al. | 313/484 |
| 4,368,465 | 1/1983 | Hirakawa et al. | 340/771 |
| 4,499,460 | 2/1985 | Pearson et al. | 340/771 |
| 4,516,053 | 5/1985 | Amano | 313/584 |
| 4,575,716 | 3/1986 | Holz et al. | 340/714 |
| 4,622,549 | 11/1986 | Criscimagna et al. | 340/805 |
| 4,638,218 | 1/1987 | Shinoda et al. | 315/169.4 |
| 4,716,341 | 12/1987 | Oida et al. | 315/169.4 |
| 4,737,687 | 4/1988 | Shinoda et al. | 315/169.4 |
| 4,814,758 | 3/1989 | Park | 340/771 |
| 5,030,888 | 7/1991 | Salavin et al. | 315/169.4 |
| 5,086,297 | 2/1992 | Miyake et al. | 340/759 |
| 5,182,489 | 1/1993 | Sano | 313/485 |
| 5,541,618 | 7/1996 | Shinoda | 345/60 |
| 5,661,500 | 8/1997 | Shinoda et al. | 345/60 |
| 5,674,553 | 10/1997 | Shinoda et al. | 427/68 |
| 5,724,054 | 3/1998 | Shinoda | 345/60 |

FOREIGN PATENT DOCUMENTS

| | | |
|---|---|---|
| 0 366 117 | 5/1990 | European Pat. Off. . |
| 0 436 416 | 7/1991 | European Pat. Off. . |
| 2 662 534 | 11/1991 | France . |
| 49-115242 | 11/1974 | Japan . |
| 50-135979 | 10/1975 | Japan . |
| 51-032051 | 9/1976 | Japan . |
| 55-5663 | 2/1980 | Japan . |
| 56-094395 | 7/1981 | Japan . |
| 57-078751 | 5/1982 | Japan . |
| 61-039341 | 2/1986 | Japan . |
| 63-151997 | 6/1988 | Japan . |
| 63-060495 | 11/1988 | Japan . |
| 1-304638 | 12/1989 | Japan . |
| 1-313837 | 12/1989 | Japan . |
| 2-219092 | 8/1990 | Japan . |
| 2-291597 | 12/1990 | Japan . |
| 3-078937 | 4/1991 | Japan . |
| 3-101031 | 4/1991 | Japan . |
| 3-77238 | 4/1991 | Japan . |

OTHER PUBLICATIONS

Gay et al., "Color Plasma Display Panels with Simplified Structure and Drive,"*SID 88 Digest*, SID International Symposium—Digest of Technical Papers, May 24–26, 1988, Anaheim, CA, pp. 157–159.

Ruckmongathan, T.N., "A Generalized Addressing Technique for RMS Responding Matrix LCDS," *1988 International Display Research Conference*, pp. 80–85.

Uchiike et al., "An 86–Ipi High–Resolution Full–Color Surface–Discharge ac Plasma Display Panels," *Proceedings of the SID*, vol. 31, No. 4, 1990, New York, NY, pp. 361–365.

Yoshikawa et al., "A Full Color AC Plasma Display with 256 Gray Scale," *Japan Display '92*, Article S16–2, pp. 605–608.

Holz, G.E., "Pulsed Gas Discharged Display with Memory," Burroughs Corporation, ECD, Plainfield, N.J. (2 pages).

Makino et al., "Improvement of Video Image Quality in AC–Plasma Display Panels by Suppressing the Unfavorable Coloration Effect with Sufficient Gray Shades Capability," *ASIA Display '95*, Proceedings of the Fifteenth International Display Research Conference, Oct. 16–18, 1995, Hamamatsu, Japan, Article S19–3, pp. 381–384.

Osamu, T., "Innovation and Commercial Viability of Large Area Plasma Display through Fujitsu's Continued R&D Activities," *IDW '96*, Proceedings of the Third International Display Workshops, vol. 2, Nov. 27–29, 1996, Kobe, Japan, pp. 7–10.

FULL COLOR SURFACE DISCHARGE TYPE PLASMA DISPLAY DEVICE

CROSS-REFERENCE TO RELATED APPLICATIONS

This application is a continuation-in-part of:

(1) immediate (first) parent application Ser. No. 08/800,759, filed Feb. 13, 1997, now pending, in turn a continuation of Ser. No. 08/469,815, filed Jun. 6, 1995, now U.S. Pat. No. 5,661,500, and Ser. No. 08/458,288 filed Jun. 2, 1995, now U.S. Pat. No. 5,674,553, both, in turn a continuation and a divisional, respectively, of application Ser. No. 08/010,169, filed Jan. 28, 1993, now abandoned, and claims priority benefit under 35 USC §119 to Japanese Patent Application Nos. 4-012976, filed Jan. 28, 1992, 4-096203 filed Apr. 16, 1992, 4-106953 filed Apr. 24, 1997, 4-106955 filed Apr. 24, 1997, and 4-110921 filed Apr. 30, 1992; and (2) immediate (second) parent application Ser. No. 08/674,161, filed Jul. 1, 1996, now U.S. Pat. No. 5,724,054, in turn a division of Ser. No. 08/405,920, filed Mar. 16, 1995 and issued as U.S. Pat. No. 5,541,618 on Jul. 30, 1996, in turn a continuation of Ser. No. 08/181,959, filed Jan. 18, 1994, now abandoned, in turn a continuation of Ser. No. 07/799,255, filed Nov. 27, 1991, now abandoned, and claims priority benefit under 35 USC §119 to Japanese Patent Application No. 2-331589, filed Nov. 28, 1990.

INCORPORATION BY REFERENCE

Each of the above related applications, of which the present application is a continuation-in-part, is incorporated herein by reference.

BACKGROUND OF THE INVENTION

1. Field of the Invention

The present invention relates to a full color surface discharge type plasma display panel (i.e., a flat display panel having a memory function, such as an AC-type PCP) and to a method and apparatus for driving the same to allow gradation, i.e., a gray scale, of its visual brightness for each cell. More specifically, the present invention relates to a full color ac plasma display device which is high in resolution and brightness of display, such that it is adaptable for use as a high quality display, such as a high definition TV, and can be used in daylight.

2. Description of the Related Art

A plasma display panel (PDP) has been considered the most suitable flat display device for a large size, exceeding over 20 inches, because a high speed display is possible and a large size panel can easily be made. It is also considered to be adaptable to a high definition TV. Accordingly, an improvement in full color display capability in plasma display panels is desired.

In the past, two electrode type dc and ac plasma display panels have been proposed and developed. Also, a surface discharge type ac plasma display panel, among other plasma display panels, has been known to be suitable for a full color display.

For example, a surface discharge type ac plasma display panel having a three electrode structure comprises a plurality of parallel display electrode pairs formed on a substrate and a plurality of address electrodes perpendicular to the display electrode pairs for selectively illuminating unit luminescent areas. Phosphors are arranged, in order to avoid damage by ion bombardment, on the other substrate facing the display electrode pairs with a discharge space between the phosphor and the display electrode pairs and are excited by ultra-violet rays generated from a surface discharge between the display electrodes, thereby causing luminescence. See for example, U.S. Pat. No. 4,638,218 issued on Jan. 20, 1987 and No. 4,737,687 issued on Apr. 12, 1988.

The full color display is obtained using an adequate combination of three different colors, such as red (R), green (G) and blue (B), and an image element is defined by at least three luminescent areas corresponding to the above three colors.

Conventionally, an image element is composed of four subpixels arranged in two rows and two columns, including a first color luminescent area, for example, R, a second color luminescent area, for example, G, a third color luminescent area, for example, G, and a fourth color luminescent area, for example, B. Namely, this image element comprises four luminescent areas of a combination of three primary colors for additive mixture of colors and an additional green having a high relative luminous factor. By controlling the additional green area independent from the other three luminescent areas, an apparent image element number can be increased and thus an apparent higher resolution or finer image can be obtained.

In this arrangement of four subpixels, two pairs of display electrodes cross an image element, i.e., each pair of display electrodes crosses each row or column of subpixels, which is apparently disadvantageous in making image elements finer.

If the image elements are to be finer, formation of finer display electrodes becomes difficult and the drive voltage margin for avoiding interference of discharge between different electrode lines becomes narrow. Moreover, the display electrodes become narrower, which may cause damage to the electrodes. Further, a display of one image element requires time for scanning two lines, which may make a high speed display operation difficult because of the frequency limitation of a drive circuit.

The present invention is directed to solve the above problem and provide a flat panel full color surface discharge type plasma display device having fine image elements.

JP-A-01-304638, published on Dec. 8, 1989, discloses a plasma display panel in which a plurality of parallel barriers are arranged on a substrate and luminescent areas, in the form of strips defined by the parallel barriers, are formed. This disclosure is, however, directed only to two electrode type plasma display panels, not to a three electrode type plasma display panel in which parallel display electrode pairs and address electrodes intersecting the display electrode pairs are arranged and three luminescent areas are arranged in the direction of the extending lines of the display electrode pairs as in the present invention.

The present invention is also directed to a plasma display panel exhibiting a high image brightness at a wide view angle range. In this connection, U.S. Pat. No. 5,086,297 issued on Feb. 4, 1992, corresponding to JP-A-01-313837 published on Dec. 19, 1989, discloses a plasma display panel in which phosphors are coated on side walls of barriers. Nevertheless, in this plasma display panel, the phosphors are coated selectively on the side walls of barriers and do not cover the flat surface of the substrate on which electrodes are disposed.

The present invention accordingly is directed to improving upon the structure of a full color, surface discharge type plasma display device so as to provide finer image elements and thus improved resolution and also increased brightness of the display while being compatible with and not introducing excessive speed (frequency) requirements on a driving circuit but providing high speed display operations. An improved display gradation, as high as 256 grades, or levels, is also required in combination with the improved structure so as to improve the picture quality of the display and thereby to obtain a picture quality at the level of high-definition television, as an example.

There have been proposed heretofore various methods for increasing the selective gradation of the display brightness, such as disclosed in Japanese Patent Publication 51-32051 or Hei 2-291597, wherein a single frame period of a picture to be displayed is divided, with respect to time, into plural subframes (SF1, SF2, SF3, etc.), and wherein each subframe has a specific time length for lighting a corresponding cell, so that the visual brightness of the cell is weighted. A typical prior art method to provide such gradation of visual brightness of a display is schematically illustrated in FIG. 1, wherein, after cells on a single horizontal line (simply referred to hereinafter as a line) $Y_1$ are selectively written, i.e., addressed, cells on the next line $Y_2$ are then written. A structure of each subframe SFn on each scanned line, as employed in an opposed-discharge type PDP panel, is shown in FIG. 2, where there are drawn voltage waveforms, as are applied across the cells on horizontal lines $Y_j$, $Y_{j+1}$, $Y_{j+2}$, . . . , respectively. Each subframe is provided with a write period CYw (or address period) during which a write pulse Pw, an erase pulse Pf and sustain pulses Ps are sequentially applied to the cells on each Y-electrode, and a sustain period CYm during which only sustain pulses are applied.

The write pulse generates a wall charge in the cells on each line and the erase pulse Pf erases the wall charge. However, for a cell to be lit, a cancel pulse Pc is selectively applied to the cell's X-electrode $X_f$ concurrently with application of the erase pulse, so as to cancel the erase pulse Pf. Accordingly, the wall charge (see FIG. 10) remains only in the cell applied with the cancel pulse Pc, that is, where the cell is written. Sustain pulses Ps are concurrently applied to all the cells; however, only the cells having the wall charge are lit.

Gradation of visual brightness, i.e., a gray scale, is proportional to the number of sustain pulses that light the cells during a frame. Therefore, different time lengths of sustain periods CYm are allocated to the subframes in a single frame, so that the gradation is determined by an accumulation of sustain pulses in the selectively operated subframes, the subframes having respective, different numbers of sustain pulses.

A problem in such prior art drive methods exists, in that a second (i.e., a subsequent) subframe must wait for the completion of a first (i.e., a preceding) subframe for all the lines, creating an idle period on each line. Therefore, if the number of the lines m=400 per frame and for 60 frames per second to achieve a brightness gradation of 16 grades (n=4), the time length $T_{SF}$ allowed for a single subframe period becomes as short as about 10 $\mu$g as an average, because $T_{SF}\times60\times400\times4=1$ sec. For executing the write period and the sustain period in such a short period, the driving pulses must be of a very high frequency. For example, in the case where the numbers of sustain pulses are 1, 2, 4 and 8 pairs in the respective subframes to achieve 16 grades, a frequency of the driving pulses must be as high as 360 kHz, as derived from:

$$\text{freq.}=(1+2+4+8)\times60\times400=360\times10^3\text{Hz}.$$

Such a high frequency drive circuit consumes a high level of power and allows less margin in its operational voltage due to the corresponding minimal storage time for the wall charge, particularly in an AC type PDP. Moreover, the high frequency operation, such as 360 kHz, may cause a durability problem of the cell. Therefore, the operation frequency cannot be easily increased, resulting in a difficulty in achieving the desired gradation.

Furthermore, in the above prior art method, a write period CYw of a line must be executed concurrently with a sustain period CYm of another line. This fact causes another problem in that the brightness control, for example, the gradation control to meet gamma characteristics of a human eye, cannot be desirably achieved.

SUMMARY OF THE INVENTION

To attain the above and other objects of the present invention, there is provided a full color surface discharge type plasma display device comprising: pairs of lines of display electrodes (X and Y), each pair of lines of display electrodes being parallel to each other and constituting an electrode pair for surface discharge; lines of address electrodes insulated from the display electrodes and running in a direction intersecting the lines of display electrodes; three phosphor layers (R, G and B), different from each other in respective luminescent colors, facing the display electrodes and arranged in a successive order of the three phosphor layers along the extending lines of the display electrodes; and a discharge gas in a space between said display electrodes and said phosphor layers, wherein portions (EU) of the adjacent three phosphor layers of said three different luminescent colors (R, G and B) and a pair of lines of display electrodes define one image element (EG) of a full color display.

In accordance with the present invention, there is also provided a full color surface discharge plasma display device comprising first and second substrates facing and parallel to each other for defining a space in which a discharge gas is filled; pairs of lines of display electrodes formed on the first substrate facing the second substrate, each pair of lines of display electrodes being parallel to each other and constituting an electrode pair for surface discharge; a dielectric layer over the display electrodes and the first substrate; lines of address electrodes formed on the second substrate facing the first substrate and running in a direction intersecting the lines of display electrodes; three phosphor layers, different from each other in respective luminescent colors, formed on the second substrate in a successive order of said three luminescent colors along the extending lines of the display electrodes, the phosphor layers entirely covering the address electrodes; and barriers standing on the second substrate to divide and separate said discharge space into cells corresponding to respective phosphor layers, the barriers having side walls; wherein the adjacent three phosphor layers of said three different luminescent colors and a pair of lines of display electrodes define one image element of a full color display and said phosphor layers extend to the side walls of said barriers to cover almost the entire surfaces of the side walls of said barriers.

In accordance with a preferred embodiment of the present invention, there is provided a full color surface discharge plasma display device comprising first and second substrates facing and parallel to each other for defining a space in which a discharge gas is filled, the first substrate being disposed on a side of a viewer; pairs of lines of display electrodes formed on the first substrate facing the second substrate, each pair of lines of display electrodes being parallel to each other and constituting an electrode pair for surface discharge, each of the display electrodes comprising a combination of a transparent conductor line and a metal line in contact with said transparent conductor line and having a width narrower than that of the transparent conductor line; a dielectric layer over the display electrodes and the first substrate; lines of address electrodes formed on the second substrate facing the first substrate and running in a direction intersecting the lines of display electrodes; barriers standing on the second substrate, in parallel to said address electrodes, for dividing said discharge gas space into cells, the barriers having side walls; and three phosphor layers, different from each other in respective luminescent colors formed on the second substrate in a successive order of said three luminescent colors along the extending lines of the display electrodes, the phosphor layers entirely covering the address electrodes and extending to the side walls of said barriers to cover almost the entire surfaces of the side walls of said barriers; wherein the adjacent three phosphor layers of said three different luminescent colors and a pair of lines of display electrodes define one image element of a full color display.

It is preferred, in the above full color surface discharge plasma display device, that each individual image element has an almost square area and that each of the three phosphor layers has a rectangular shape, obtained by dividing the square area of the image element in equal thirds, each of which thirds is elongated in a direction perpendicular to the lines of display electrodes. Additionally, it is preferred that each of the lines of the display electrodes comprises a combination of a transparent conductor line and a metal line in contact with the transparent conductor line and having a width narrower than that of the transparent conductor line and is disposed on the side of a viewer compared with the phosphor layers; the transparent conductor lines have partial cutouts in such a shape that the surface discharge is localized to a portion between the display electrodes without the cutout in each unit luminescent area; the total width of a pair of the display electrodes and a gap for discharge formed between the pair of the display electrodes is less than 70% of a pitch of the pairs of display electrodes; the device further comprises barriers standing on a substrate and dividing and separating the space between the display electrodes and the phosphor layers into cells corresponding to respective phosphor layers; the barriers have side walls and the phosphor layers extend to and almost entirely cover the side walls of the barriers; the address electrodes exist on a side of the substrate opposite to the display electrodes and the address electrodes are entirely covered with the phosphor layers; the device further comprises a substrate and a underlying layer of a low melting point glass containing a light color colorant formed on the substrate and the address electrodes are formed on the underlying layer; at least part of the barriers comprises a low melting point glass containing a light color colorant; and the barriers comprise a low melting point glass containing a dark color colorant in a top portion thereof and a low melting point glass admixed with a light color colorant in the other portion.

In accordance with the present invention, there is also provided a process for manufacturing a full color surface discharge plasma display device as-above, as more fully described in above-identified, immediate (first) parent application hereof.

The improved plasma display device of the present invention furthermore may be driven in accordance with the drive control system disclosed in the above-identified, immediate (first) parent application and, alternatively and preferably, by the disclosed drive system of the immediate (second) parent application Ser. No. 08/674,161 as above-identified. In accordance with the latter, a high degree of gradation of visual brightness of a flat display panel is achieved by requiring less time for addressing cells to be lit. More particularly, in a flat display panel in which the cells are formed at corresponding cross points of a plurality of X-electrodes and a plurality of Y-electrodes orthogonal to the X-electrodes, a period of a frame for displaying a single picture is divided into a plurality of sequential subframes. Each of the subframes comprises an addressing period during which cells, to be lit later in a display period, are selected from all remaining cells of the panel by being written by having a wall charge established therein, and a display period, which is subsequent to the address period and during which lighting of the selected cells is produced by applying sustain pulses to all the cells. A number of the sustain pulses included in each display period is predetermined and differs for each subframe according to a weight given to each subframe. Gradation of visual brightness of each cell is determined by the accumulated number of the sustain pulses included in the subframes which are selectively operated during a single frame according to the brightness level specified in a picture data to be displayed.

The above-mentioned features and advantages of the present invention, together with other objects and advantages, which will become apparent, will be more fully described hereinafter, with reference to the accompanying drawings which form a part hereof and wherein like numerals refer to like parts throughout.

DESCRIPTION OF THE PREFERRED EMBODIMENTS

Before describing the structure of a display panel of the present invention in more detail, the prior art is described with reference to the drawings of FIGS. 2A to 3B so as to facilitate a better understanding of the present invention.

Figure 2A:
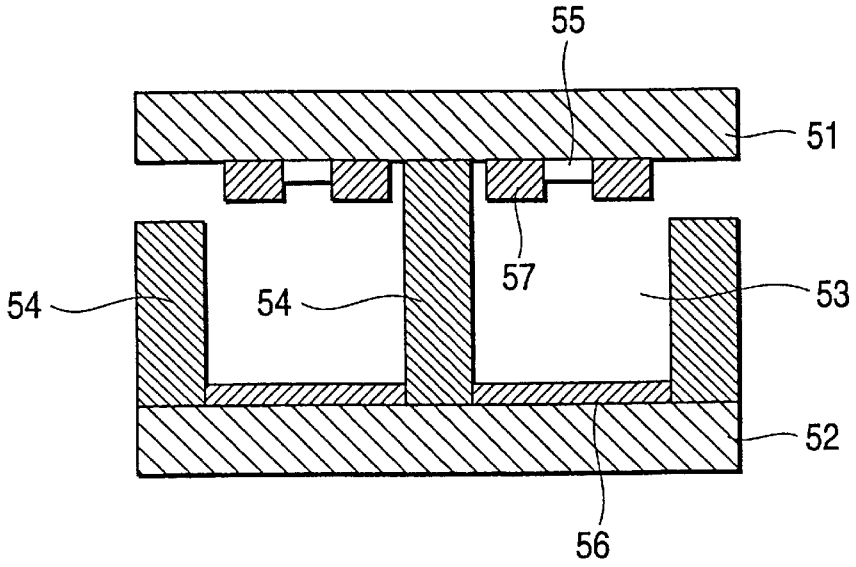
FIG. 2A (PRIOR ART)
FIG. 2A shows a first structure of plasma display devices of the prior art.
Figure 2B:
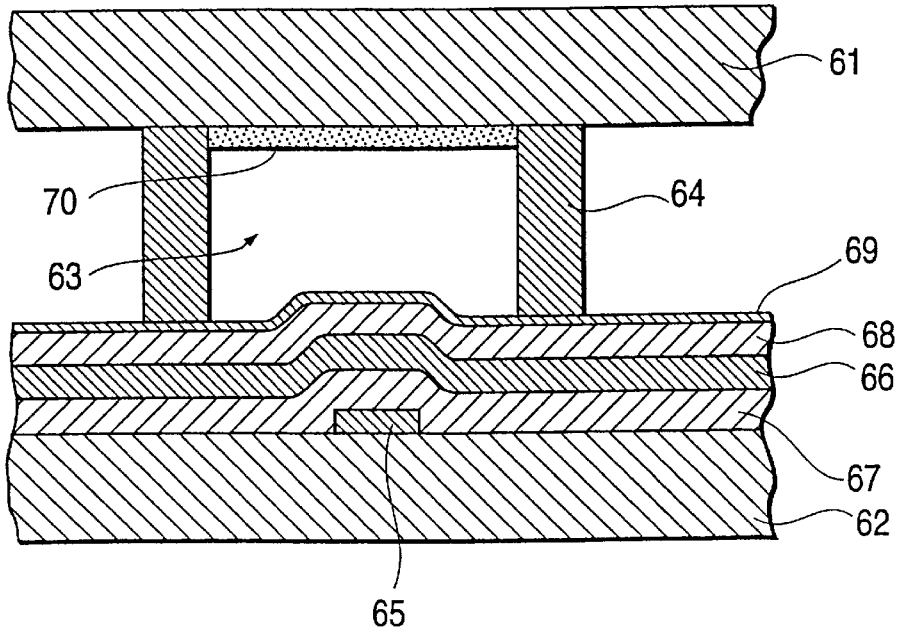
FIG. 2B (PRIOR ART)
FIG. 2B shows a second structure of plasma display devices of the prior art.

FIGS. 2A and 2B show the basic constructions of dc and ac two electrode plasma display panels, respectively. These constructions of two electrode plasma display panels appear in FIGS. 5 and 6 of JP-A-01-304638. In FIG. 2A of the present application, illustrating an opposite discharge type dc plasma display panel, two substrates 51 and 52 face each other in parallel. Gas discharge cells 53 are defined by straight cell barriers 54 and the two substrates 51 and 52. A discharge gas exists in the discharge cells 53. An anode 55 is formed on a substrate 51 on the side of the viewer. A cathode 56 is formed on the other substrate 52. A phosphor layer 57, in the form of strip, is formed on the substrate 51, such that the anode 55 and the phosphor layer 57 do not overlap each other. When a dc voltage is applied between the anode 55 and the cathode 56, an electric discharge emitting ultra-violet rays occurs in the discharge cell 53, which illuminates the phosphor layer 57. Separating the phosphor layer 57 from the anode 55 prevents damage of the phosphor layer by ion bombardment due to the discharge, since if the phosphor layer overlaps the anode 55, ion bombardment of the anode damages the phosphor layer on the anode 55.

This conventional panel is an opposite discharge type and is different from the surface discharge type of the present invention. Although the phosphors and barriers are straight, or in the form of strips, the opposite electrodes are arranged to intersect with each other and the phosphors extend in the direction of one of the extending lines of the opposite electrodes. In the opposite discharge type plasma display panel, ions generated during the discharge bombard and deteriorate the phosphors, thereby shortening the life of the panel. In contrast, in a three electrode surface discharge type panel, discharge occurs between the parallel display electrode pairs formed on one substrate, which prevents deterioration of the phosphor disposed on the other side substrate.

FIG. 2B illustrates a prior art surface discharge type ac plasma display device wherein two substrates 61 and 62 face each other in parallel. Gas discharge cells 63 are defined by straight cell barriers 64 and the two substrates 61 and 62. A discharge gas exists in the discharge cells 63. Two electrodes 65 and 66, arranged normal to each other in plane view, are formed on the substrate 62 with a dielectric layer 67 therebetween. A second dielectric layer 68 and a protecting layer 69 are stacked on the dielectric layer 67. A phosphor layer 70 is formed as a strip on the substrate 61. When an electric field is applied between the two electrodes 65 and 66, a discharge occurs generating ultraviolet rays which illuminate the phosphor layer 70.

In this conventional surface discharge type panel, the straight barriers and the strip phosphors are parallel to each other, but the pair of display electrodes are arranged to intersect with each other and the phosphors extend in the direction of one of the display electrode pair. In contrast, the three different luminescent color phosphors are arranged in the extending direction of the parallel display electrode pairs.

This conventional surface discharge type panel has several disadvantages. Selection of the materials of the X and Y display electrodes is difficult since the two electrode layers X and Y are stacked upon each other (as a dielectric layer disposed between the two display electrodes is made of a low melting point glass, failure of the upper electrode on the low melting point glass or a short circuit may occur when the low melting point glass is fired). Additionally, a protecting layer at the cross section (i.e., intersection) of the X and Y display electrodes is damaged by discharge due to the electric field concentration there, which causes variation of the discharge voltage. Further, a large capacitance caused by the stack of the two electrodes on one substrate results in a disadvantageous drive. As a result of these disadvantages, this type of panel has never been put into practical use.

Figure 2C:
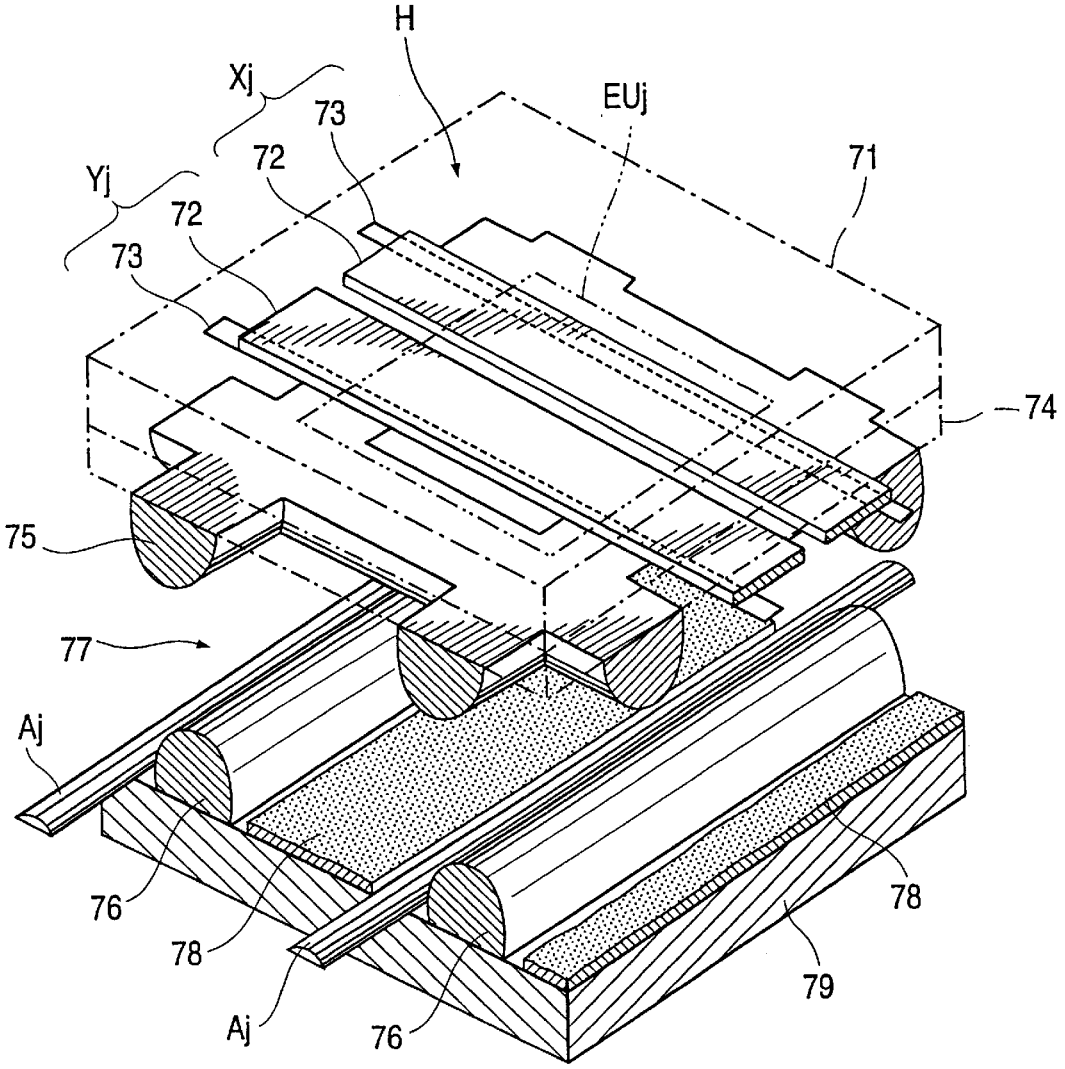
FIG. 2C (PRIOR ART)
FIG. 2C shows a third structure of plasma display devices of the prior art.

Also known is a three electrode type surface gas discharge ac plasma display panel, as shown in FIG. 2C. A display electrode pair Xj and Yj, each comprising a transparent conductor strip 72 and a metal layer 73, are formed on a glass substrate 71 on the display surface side H. A dielectric layer 74 for an ac drive is formed on the substrate 71 to cover the display electrodes Xj and Yj. A first barrier 75 in the form of a cross lattice, defining a unit luminescent area EUj, is formed on the glass substrate 71. Parallel second barriers 76, corresponding to the vertical lines of the barrier 75, are formed on a glass substrate 79 so that discharge cells 77 are defined between the substrates 71 and 79 by the first and second barriers 75 and 76. An address electrode Aj and a phosphor layer 78 are formed on the substrate 79. The address electrode Aj, which selectively illuminates the unit luminescent area EU, and the phosphor layer 78 intersect the display electrode pair Xj and Yj. The address electrode Aj is formed adjacent to the one side barrier 76 and the phosphor layer 78 is adjacent to the other side barrier 76. The address electrode Aj may be formed on the side of the substrate 71, for example, below the display electrode pairs Xj and Yj with a dielectric layer therebetween.

In this ac plasma discharge panel, erase addressing, in which writing (i.e., formation of a stack of wall charges) of a line L is followed by selective erasing, and a self-erase discharge is utilized for selective erasing, are typically used.

Figure 3:
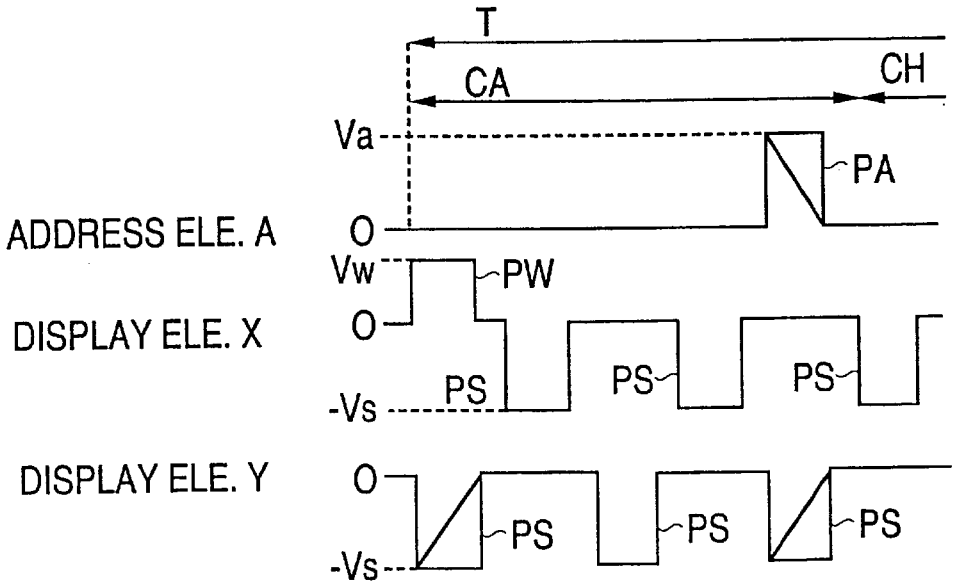
FIG. 3 (PRIOR ART)
FIG. 3 shows alternative prior art driving waveforms for operation of a plasma display device.

More specifically and referring to FIGS. 2C and 3, in an initial address cycle CA of a line display period T corresponding to one line display, a positive writing pulse PW having a wave height Vw is applied to display electrodes Xj, which correspond to a line to be displayed. Simultaneously, a negative discharge sustain pulse having a wave height Vs is applied to a display electrode Y corresponding to the line to be displayed. In FIG. 3, the inclined line added to the discharge sustain voltage PS indicates that it is selectively applied to respective lines.

At this time, a relative electrical potential between the display electrodes Xj and Yj, i.e., a cell voltage applied to the surface discharge cell, is above the firing voltage; therefore, surface discharge occurs in all surface discharge cells C corresponding to one line. By the surface discharge, wall charges, having polarities opposite to those of the applied voltage, are stacked on the protecting layer 18 and, accordingly, the cell voltage is lowered to a predetermined voltage at which the surface discharge stops. The surface discharge cells are then in the written state.

Next, a discharge sustain pulse PS is alternately applied to the display electrodes Xj and Yj, and by superimposing the voltage Vs of the discharge sustain pulse PS onto the wall charges, the cell voltages then become the above firing voltage and surface discharge occurs every time one of the discharge sustain pulses PS is applied.

After the written state is made stable by a plurality of surface discharges, at an end stage of the address cycle CA, a positive selective discharge pulse PA having a wave height Va is applied to address electrodes corresponding to unit luminescent areas EU to be made into a non-display state in one line. Simultaneously, the discharge sustain pulse PS is applied to the display electrode Yj, to erase the wall charges unnecessary for display (selective erase). In FIG. 3, the inclined line added to the selective discharge pulse PA indicates that it is selectively applied to each of the unit luminescent areas EU in one line.

At a rising edge of the selective discharge pulse PA, an opposite discharge occurs at an intersection between the address electrode Aj and the display electrode Yj in the direction of the gap of the discharge space 30 between the substrates 11 and 21. By this discharge, excess wall charges are stacked in surface discharge cells and when the selective discharge pulse PA is lowered and the discharge sustain pulse PS is raised, a discharge due to the wall charges only occurs (self-erase discharge). The self-erase discharge has a short discharge sustain time since no discharge current is supplied from the electrodes. Accordingly, the wall charges disappear in the form of neutralization.

In the following display cycle CH, the discharge sustain voltage PS is alternately applied to the display electrodes Xj and Yj. At every rising edge of the discharge sustain voltage PS, only the surface discharge cells C in which the wall charges are not lost are subject to discharge, by which ultra-violet rays are irradiated to excite and illuminate the phosphor layers 28. In the display cycle CH, the period of the discharge sustain voltage PS is selected so as to control the display brightness.

The above operation is repeated for every line display period T and the display is performed for respective lines.

It is noted that it is possible for the writing to be performed simultaneously for all lines, followed by line-by-line selective erasing of wall discharges, so that the writing time in an image display period (field) is shortened and the operation of display is sped up.

In this three electrode type ac plasma discharge panel, the selection of the discharge cell for electric discharge is memorized and the power consumption for display or sustainment of discharge can be lowered. Second, the electric discharge occurs near the surface of the protecting layer on the display electrode pair Xj and Yj so that damage of the phosphor layer by ion bombardment can be prevented, particularly when the phosphor layer and the address electrode are separated.

Figure 4:
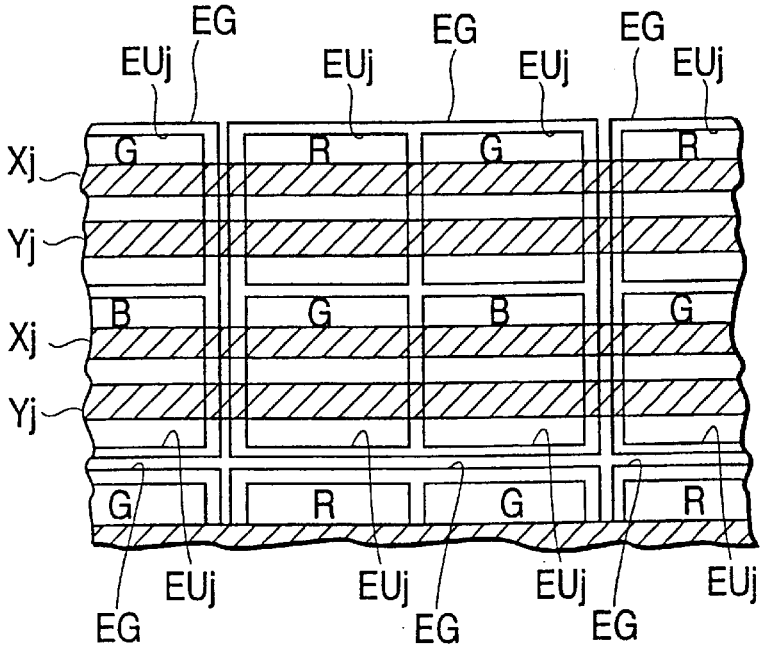
FIG. 4 (PRIOR ART)
FIG. 4 shows a fourth structure of plasma display devices of the prior art.

FIG. 4 shows a typical arrangement of three different color phosphor layers for a full color display in a three electrode type ac plasma discharge panel. In FIG. 4, EG denotes an image element, EUj denotes a unit luminescent area, R denotes a unit luminescent area of red, G denotes a unit luminescent area of green, B denotes a unit luminescent area of blue, and Xj and Yj denote a pair of display electrodes, respectively.

As seen in FIG. 4, one display line L is defined by the pair of display electrodes Xj and Yj, and each image element EG is composed of four unit luminescent areas EUj of two rows and two columns, to which two lines L, i.e., four display electrodes Xj and Yj correspond. In an image element EG, the a left upper unit luminescent area EUj is a first color, e.g. R, the right upper and left lower unit luminescent areas EUj are a second color, e.g. G, and the right lower unit luminescent area EUj is a third color, e.g., B. More specifically, the image element EG includes a combination of unit luminescent areas EUj of the three primary colors for mixture of additive colors. EG also includes an additional unit luminescent area EUj of green having a high relative luminous factor. The additional unit luminescent area EUj of green permits an increase in the apparent number of image elements by independent control thereof from the other three unit luminescent areas EUj.

In this arrangement of the unit luminescent areas EUj, as described before, the four display electrodes required in an image element are disadvantageous in making the image elements finer. First, the formation of a fine electrode pattern has a size limitation. Second, if the gap between the display lines L is too narrow, a margin for preventing an interference between discharges on the display lines becomes too small. Third, if the width of the display electrodes is too narrow, the display electrodes tend to be broken or cut. Fourth, a display of an image element requires time for scanning two lines L, which may make a high speed display operation difficult, particularly when a panel size or image element number is increased.

Figure 5:
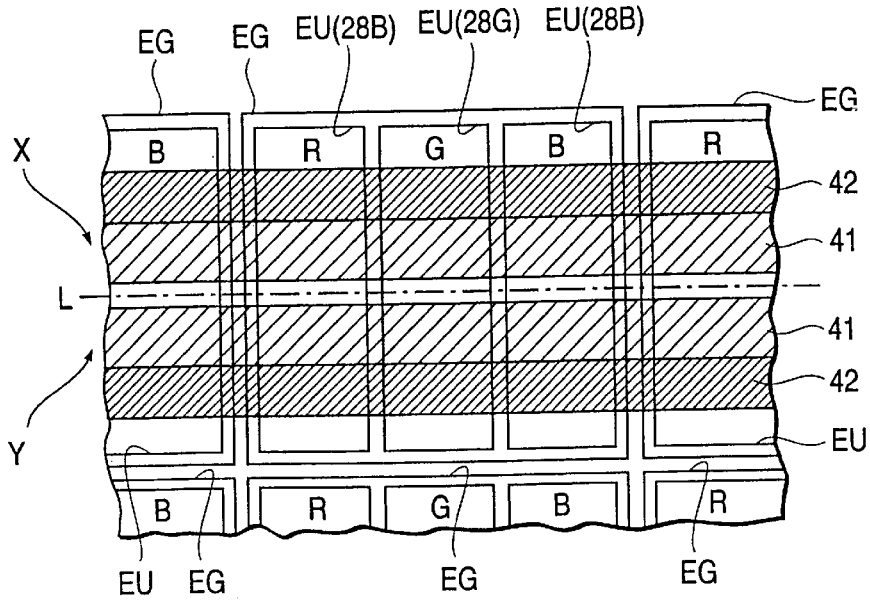
FIG. 5 schematically shows the basic construction of a full color surface discharge type plasma display device of the present invention.
Figure 6:
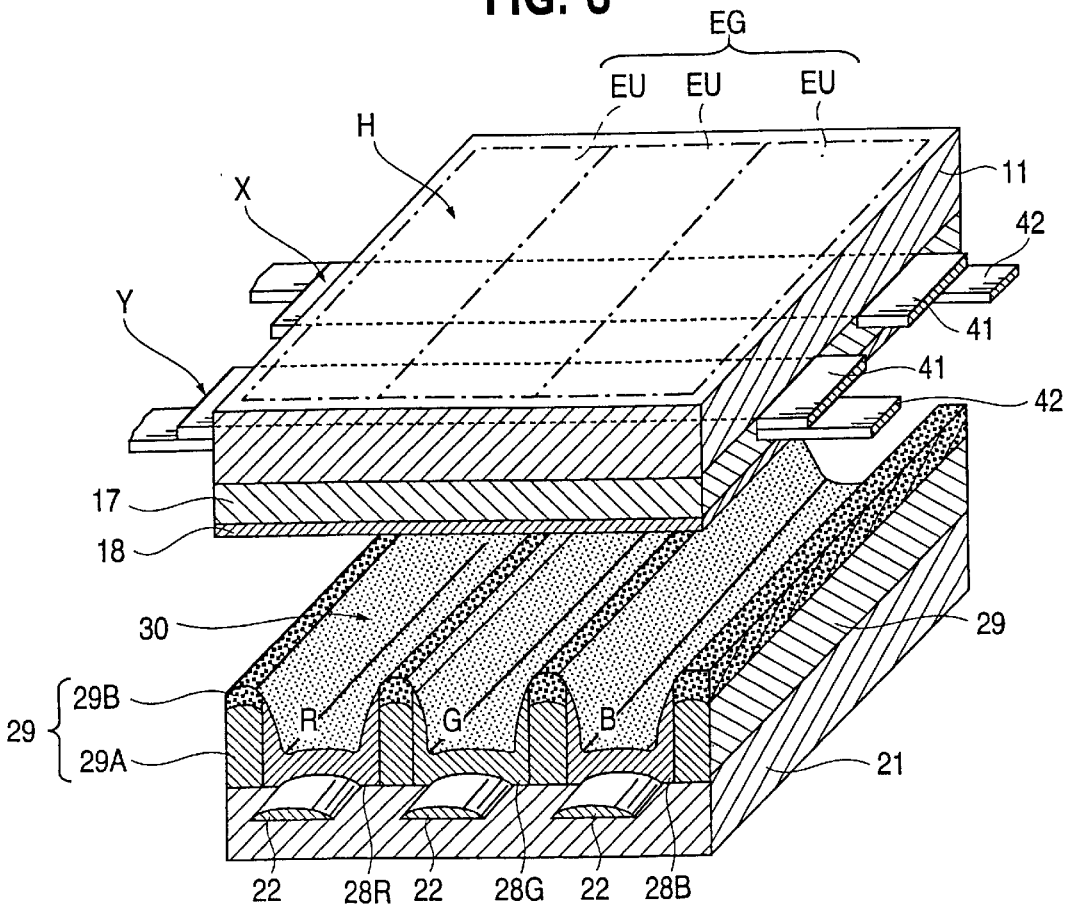
FIG. 6 is a perspective view of a full color flat panel ac plasma display device of the present invention.

In accordance with the present invention and with reference to FIGS. 5 and 6, the above problems are solved by a display device comprising pairs of lines of display electrodes X and Y; lines of address electrodes 22 insulated from the display electrodes X and Y and running in a direction intersecting the lines of display electrodes X and Y; areas of three phosphor layers 28R, 28G and 28B different from each other in luminescent color, facing the display electrodes and arranged in a successive order of the three phosphor layers along the extending lines of the display electrodes X and Y; and a discharge gas in a space 30 between the display electrodes X and Y and the phosphors, such that the adjacent three phosphor layers EU of the three different luminescent colors 28R, 28G and 28B and a pair of lines of display electrodes X and Y define one image element EG of a full color display.

In this construction, only one display electrode pair, i.e., two display electrodes, is arranged in one image element. Accordingly, it is possible to reduce the size of the image elements. Also, it is possible to increase the area where display electrodes do not cover an image element so that the brightness of the display can be increased since metal electrodes interrupt illumination from the phosphors.

FIG. 5 is a plane view of an arrangement of display electrodes X and Y in an image element EG and FIG. 6 is a schematic perspective view of a structure of an image element.

Referring to FIG. 6, a three electrode type surface gas discharge ac plasma display panel is shown that comprises a glass substrate 11 on the side of the display surface H; a pair of display electrodes X and Y extending transversely parallel to each other; a dielectric layer 17 for an ac drive; a protecting layer 18 of MgO; a glass substrate 21 on the background side; a plurality of barriers extending vertically and defining the pitch of discharge spaces 30 by contacting the top thereof with the protecting layer 18; address electrodes 22 disposed between the barriers 29; and phosphor layers 28R, 28G and 28B of three primary colors of red R, green G and blue B.

The discharge spaces 30 are defined as unit luminescent areas EU by the barriers 29 and are filled with a Penning gas of a mixture of neon with xenon (about 1–15 mole %) at a pressure of about 500 Torr as an electric discharge gas emitting ultra-violet rays for exciting the phosphor layers 28R, 28G and 28B.

In FIG. 6, the barriers 29 are formed on the side of the substrate 21 but are not formed on the side of the substrate 11, which is advantageous in accordance with the present invention and described in more detail later.

Each of the display electrodes X and Y comprises a transparent conductor strip 41, about 180 μm wide, and metal layer 42, about 80 μm wide, for supplementing the conductivity of the transparent conductor strip 41. The transparent conductor strip 41 are, for example, a tin oxide layer and the metal layers 42 are, for example, a Cr/Cu/Cr three sublayer structure.

The distance between a pair of the display electrodes X and Y, i.e.,the discharge gap, is selected to be about 40 μm and an MgO layer 18 about a few hundred nano meters thick is formed on the dielectric layer 17. The interruption of a discharge between adjacent display electrode pairs, or lines, L can be prevented by providing a predetermined distance between the adjacent display electrode pairs, or lines, L. Therefore, barriers for defining discharge cells corresponding to each line L are not necessary. Accordingly, the barriers may be in the form of parallel strips, not the cross lattice enclosing each unit luminescent area, as shown in FIG. 3, and thus, can be very much simplified.

The phosphors 28R, 28G and 28B are disposed in the order of R, G and B from the left to the right to cover the surfaces of the substrate 21 and the barriers 29 defining the respective discharge spaces there-between. The phosphor 28R emitting red luminescence is of, for example, (Y, Gd)BO3:$EU^{2+}$, the phosphor 28G emitting green luminescence is of, for example, $Zn_2SiO_4$:Mn, and the phosphor 28B emitting blue luminescence is of, for example, $BaMgAl_{14}O_{23}$:$Eu^{2+}$. The compositions of the phosphors 28R, 28G and 28B are selected such that the color of the mixture of luminescence of the phosphors 28R, 28G and 28B when simultaneously excited under the same conditions is white.

At an intersection of one of a pair of display electrodes X and Y with an address electrode 22, a selected discharge cell, not indicated in the figures, for selecting display or non-display of the unit luminescent area EU is defined. A primary discharge cell, not indicated in the figures, is defined near the selected discharge cell by a space corresponding to the phosphor. By this construction, a portion, corresponding to each unit luminescent area EU, of each of the vertically extending phosphor layers 28R, 28G and 28B can be selectively illuminated and a full color display by a combination of R, G and B can be realized.

Referring to FIG. 5, respective image elements are comprised of three unit luminescent areas EU arranged transversely and having the same areas. The image elements advantageously have the shape of a square for high image quality and, accordingly, the unit luminescent areas EU have a rectangular shape elongated in the vertical direction, for example, about 660 μm×220 μm.

A pair of display electrodes are made corresponding to each image element EG, namely, one image element EG corresponds to one line L.

Accordingly, in comparison with the case of the prior art structure of FIG. 4 in which two lines L correspond to one image element EG, the number of the electrodes in an image element EG is reduced by half in the construction of the present invention, as shown in FIGS. 5 and 6.

If the area of one image element EG is selected to be the same as that of the prior art, the width of the display electrodes X and Y can be almost doubled. As the width of the display electrodes X and Y is larger, the reliability is increased since the probability of breaking the electrodes is reduced.

Further, the width of the transparent conductor strip 41 can be made sufficiently large, compared to the width of the metal layer 42 that is necessarily more than a predetermined width to ensure the conductivity over the entire length of the line L. This allows an increase in the effective area of illumination and thus the display brightness.

For example, in the arrangement of FIG. 2C, the width of the display electrodes Xj and Yj is 90 μm, the gap between a pair of the display electrodes Xj and Yj is 50 μm, and the width of the unit luminescent area EUj is 330 μm. The gap between a pair of display electrodes Xj and Yj of at least 50 μm is necessary to ensure a stable initiation of discharge and a stable discharge. A width of the display electrodes Xj and Yj of 90 μm is selected because a metal layer having at least a 70 μm width is necessary to ensure conductivity for a 21 inch (537.6 mm) line L or panel length. Moreover, the total width of the pair of display electrodes Xj and Yj and the gap therebetween should be not more than about 70% of the width of the unit luminescent area EUj, as determined in accordance with the present invention. Accordingly, in an image element EG having a total width of 330 μm×2=660 μm, the total width of four display electrodes Xj and Yj is 90 μm×4=360 μm and the total width of the four metal layers in the display electrodes Xj and Yj is 70 μm×4=280 μm. The total width of the metal layers is 70 μm×4=280 μm and the effective illumination area is (660 μm 280 μm)=380 μm, 58% of the image element.

In comparison with the above, in the construction as shown in FIGS. 5 and 6, if the total width of the image element EG is selected to be the same as above, i.e, 660 μm, the total width of the pair of display electrodes X and Y and the gap therebetween can be 460 μm, the gap between a pair of the display electrodes X and Y is 50 μm, and accordingly, the width of each of the display electrodes X and Y is 210 μm including the width of the metal layer 42 of 70 μm and the rest width of the transparent conductor strip 41 of 140 μm. The width of each display electrode of 210 μm is 233% of the width of the prior art of 90 μm. The total width of the metal layers 42 is only 70 μm×2=140 μm and the effective illumination area is (660 μm−140 μm)=520 μm, 79% of the image element, which is about 138%, compared to that of the prior art, which is 58%.

Of course, although the size of an image element is made the same in the above comparison, it is possible in the present invention for the size of an image element to be decreased without the risk of the display electrodes breaking and a very fine display can easily be attained.

Further, although the above is a so-called reflecting type panel in which the phosphor layers 28R, 28G and 28B are disposed on the background side glass substrate 21, the present invention may also be applied to a so-called transmission type panel in which the phosphor layers 28R, 28G and 28B are disposed on the display surface side glass substrate 11.

Referring back to FIG. 2C, a gap of the discharge cells 77 between the two substrates 71 and 79 or the total height of the barriers 75 and 76 is generally selected to about 100 to 130 $\mu$m for alleviating the shock by ion bombardment during discharge. Accordingly, when one observes from the side of the display surface H of a plasma display panel in which the phosphor layer 78 is disposed only on the glass substrate 79, the view is disturbed by the barriers 75 and 76. Thus, the viewing angle of display of a panel of the prior art is narrow and it becomes narrower as the fineness of the display image elements becomes higher. Further, the surface area of the phosphor layer 78 in the unit luminescent area EUj, i.e., the substantial luminescence area, is small, which renders the brightness of display low even when viewed from the right front side of the panel.

To solve this problem, in accordance with the present invention, the phosphor layer is formed not only on the surface of one substrate facing the display electrodes but also on the side walls of the barrier. Further, on the surface of the one substrate, the phosphor layer is also formed on the address electrode, even if present.

In this construction, it is apparent that the viewing angle of display is widened since the phosphor layers on the side walls of the barriers contribute to the display and the luminescent area is enlarged by the phosphor covering the barriers and the address electrode.

Figure 7:
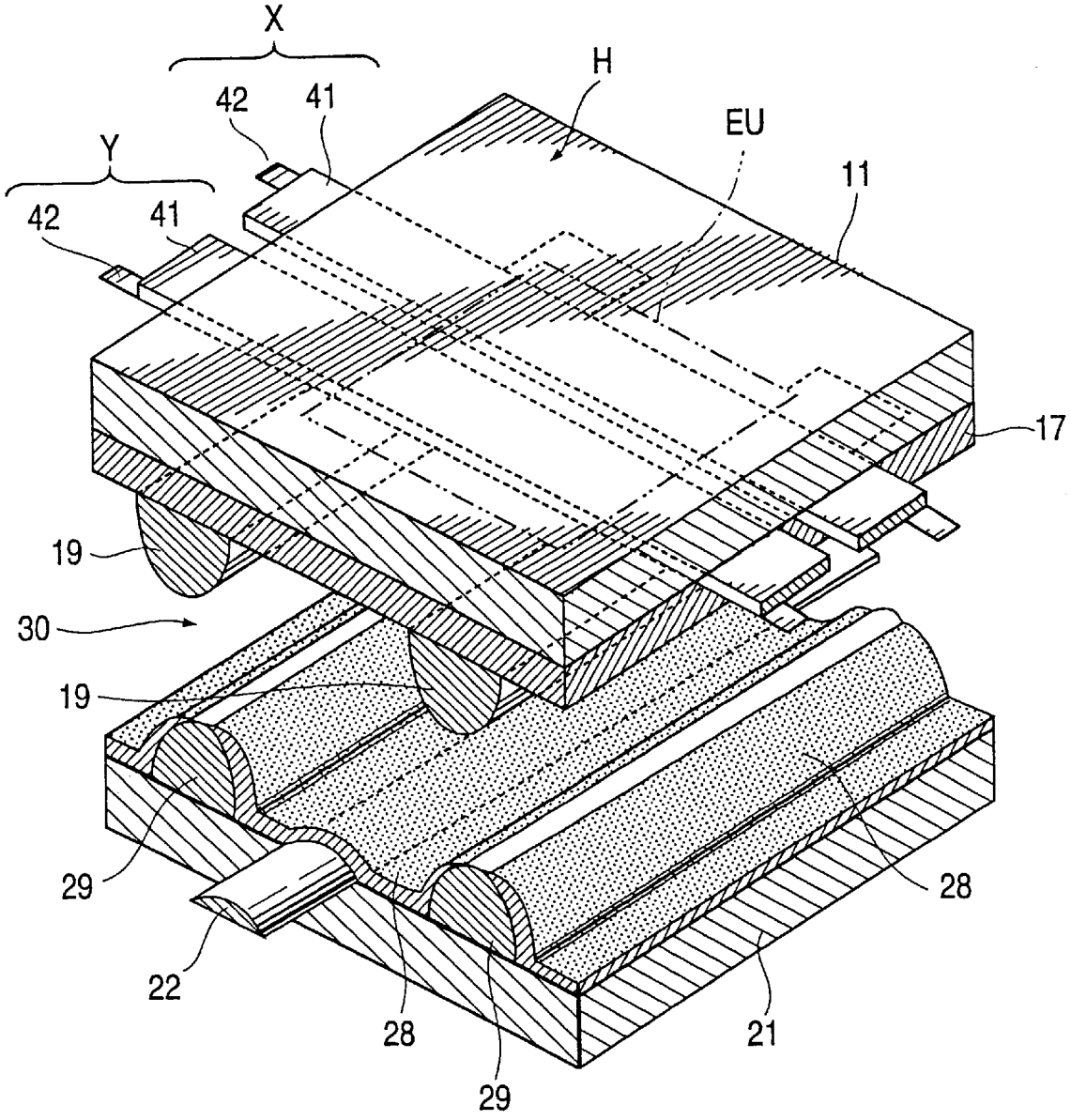
FIG. 7 is one perspective view of another full color flat panel ac plasma display device of the present invention.
Figure 8:
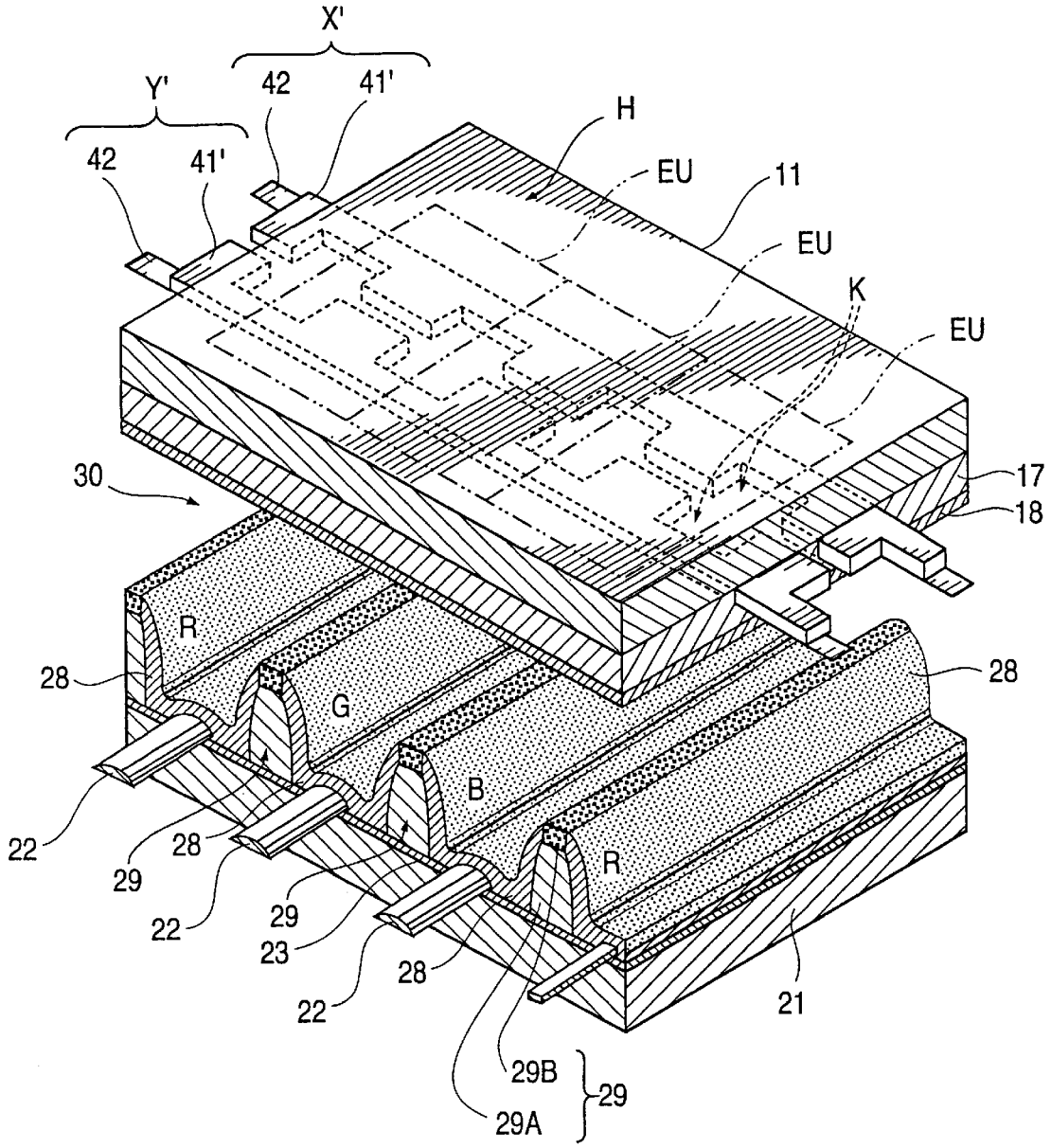
FIG. 8 is a second perspective view of another full color flat panel ac plasma display device of the present invention.

FIG. 7 shows another example of a plasma display panel according to the present invention which is very similar to that shown in FIG. 6 except that the barriers 19 and 29 are formed on both substrates 11 and 21, respectively. FIG. 8 shows a further example of a plasma display panel according to the present invention which is very similar to that shown in FIG. 6 except that the display electrodes have a particular shape. In FIGS. 7 and 8, the reference numbers denoting parts corresponding to the parts of FIG. 2 are the same as in FIG. 6.

In FIG. 7, the barriers 19 and 29 are made of a low melting point glass and correspond to each other to define the discharge cells 30, each barrier having a width of, for example, 50 $\mu$m.

In the gap between the barriers 29 on the substrate 21, address electrodes 22 having a predetermined width, for example, 130 $\mu$m, are disposed, for example, by printing and firing a pattern of a silver paste.

The phosphor layers 28 (28R, 28G and 28B) are coated on the entire surface of the glass substrate 21 including the side walls of the barriers 29 except for a top portion of the barriers 29 for contacting the member of the substrate 21, more specifically, a portion for contacting the protecting layer 18 of MgO in FIGS. 6 and 7 and the barriers 19 in FIG. 7. Almost the entire surface of the unit luminescent area EU including the side walls of the barriers 29 and the surface of the address electrodes 22 are covered with the phosphor layers 28.

In the plasma display panel shown in FIG. 8, the display electrodes X' and Y' comprise transparent conductor strips 41' having cutouts K for localizing the discharge and strips of metal layers 42 having a constant width. The transparent conductor strips 41' are arranged with a predetermined discharge gap at a central portion of a unit luminescent area EU and larger widths at both end portions of the unit luminescent area EU to restrict the discharge so that discharge interference between the adjacent unit luminescent areas EU is prevented and, as a result, a wide driving voltage margin is obtained. The total width of the display electrodes X' and Y' and the gap therebetween is made to be not more than 70% of the width of the unit luminescent area EU or the pitch of the adjacent display electrodes.

On the rear glass substrate 21, an underlying layer 23, an address electrode 22, barriers 29 (29A and 29B) and phosphor layers 28 (28R, 28G and 28B) are laminated or formed.

The underlying layer 23 is of a low melting point glass, and is higher than that of the barriers 29, and serves to prevent deformation of the address electrodes 22 and the barriers 29 during thick film formation by absorbing a solvent from pastes for the address electrodes 22 and the barriers 29. The underlying layer 23 also serves as a light reflecting layer by coloring, e.g., white by adding an oxide or others.

The address electrodes 22 are preferably of silver which can have a white surface by selecting suitable firing conditions.

The barriers 29 have a height almost corresponding to the distance of the discharge space 30 between the two substrates 11 and 21 and may be composed of low melting point glasses having different colors depending on the portions. The top portion 29B of the barriers 29 has a dark color, such as black, for improving the display contrast and the other portion 29A of the barriers 29 has a light color, such as white, for improving the brightness of the display. This kind of barriers 29 can be made by printing a low melting point glass paste containing a white colorant, such as aluminum oxide or magnesium oxide, several times followed by printing a low melting point glass paste containing a black colorant and then firing both low melting point glass pastes together.

The phosphor layers 28 (R, G and B) are coated so as to cover the entire inner surface of the glass substrate 21 except for portions of the barriers 29 that are to make contact with the protecting layer 18 on the substrate 11 and portions nearby. Namely, the walls of the substrate 21 in the discharge space of the unit luminescent area EU, including the side walls of the barriers 29 and the address electrodes 22, are almost entirely covered with the phosphor layers 28. R, G and B denote red, green and blue colors of luminescence of the phosphor layers 28, respectively.

It is possible for an indium oxide or the like to be added to the phosphor layers 28 to provide conductivity in order to prevent stack of electric charge at the time of the selective discharge and make the drive easily and stable depending on a driving method.

In this embodiment of FIG. 8, the phosphor layers 28 cover almost the entire surface of the barriers 29, which have an enlarged phosphor area compared to that of the embodiment of FIG. 7, so that the viewing angle and the brightness of the display are improved.

Further, since the underlying layer 23 and the barriers 29A are rendered a light color, such as white, the light that is emitted toward the background side is reflected by these light color members so that the efficiency of the utilization of light is improved, which is advantageous for obtaining a high display brightness.

Figure 9:
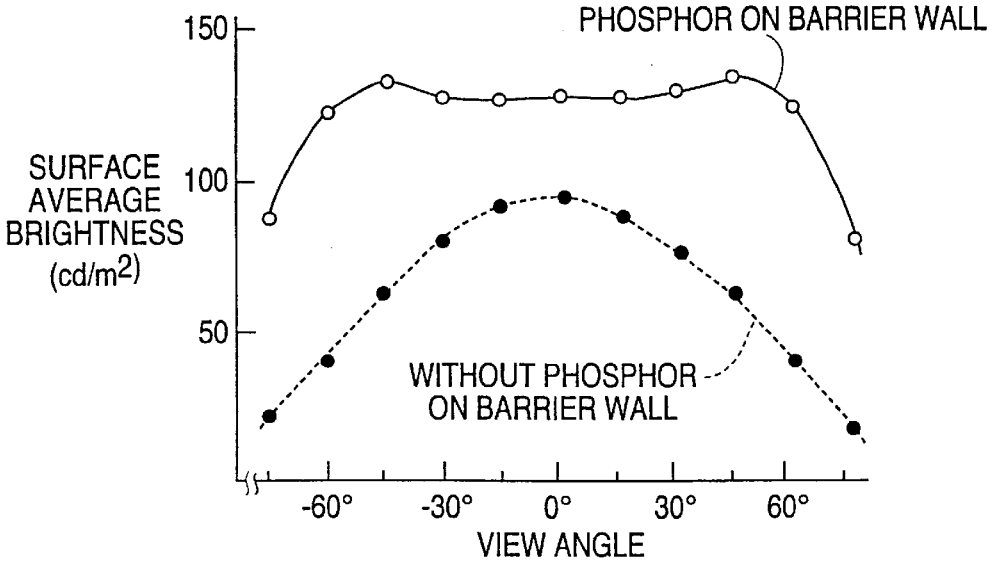
FIG. 9 is a first graph illustrating the brightness of display versus the view angle.

FIG. 9 shows the brightness of panels at various view angles. The solid line shows a panel A in which the phosphor layers 28 also cover the side walls 29 of the barriers and the broken line shows a panel B in which the phosphor layers 28 do not cover the side walls 29 of the barriers. The panels A and B have the same construction but do not have the same phosphor coverage. It is seen from FIG. 9 that at the right front side of the display surface H (view angle of 0°), the brightness of the panel A is about 1.35 times that of the panel B, and in a wide viewing angle of −60° to +60°, the brightness of the panel A is above or almost equal to that of the panel B obtained at the right front of the display surface H.

Figure 10:
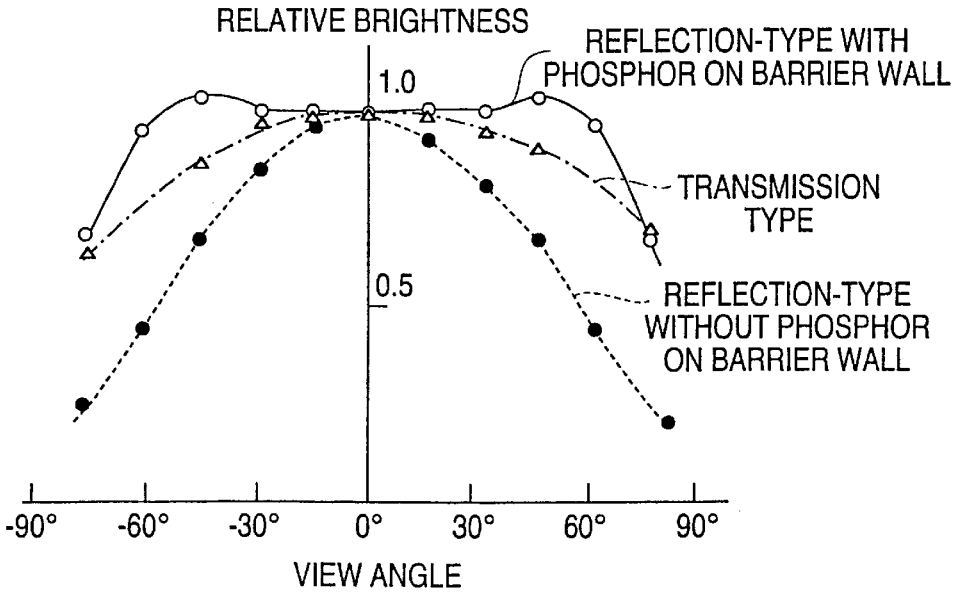
FIG. 10 is a second graph illustrating the brightness of display versus the view angle.

FIG. 10 shows the dependency of the display brightness on the view angle. The brightness of the display dependent on the view angle of a reflection type panel with phosphor layers on the side walls of the barriers, is shown to be even better than that of a transmission type panel, i.e., a panel in which the phosphor layers are disposed on a glass substrate of the side of the display surface EU.

As described before, it was found that the ratio of the total width of the display electrode pair X and Y including the width of the gap therebetween to the entire width of a unit luminescent area EU (hereinafter referred to as "electrode occupy ratio") should be not more than 70%, in order to avoid discharge interference between the adjacent lines L or display electrode pairs when there are no barriers between the adjacent lines L or display electrode pairs. Barriers between adjacent lines L or display electrode pairs are not necessary and can be eliminated if the electrode occupy ratio is selected to be not more than 70% of the entire width of a unit luminescent area EU.

Figure 11:
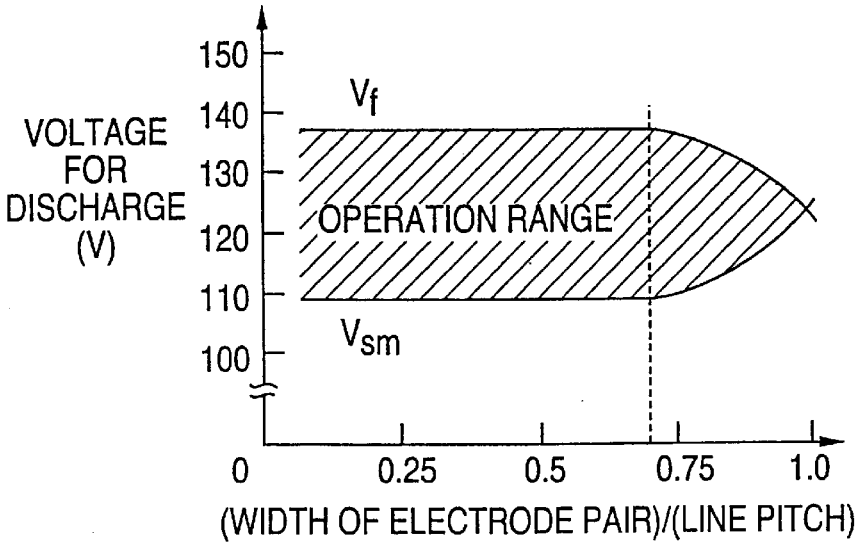
FIG. 11 is a first graph to illustrate how the stability of the discharge varies based on the structures of the barriers.

FIG. 11 shows the firing voltage V, and the minimum sustain voltage $V_{sm}$ when the electrode occupy ratio is varied. As seen in FIG. 11, if the electrode occupy ratio exceeds over about 0.7, the firing voltage $V_f$ decreased and erroneous discharge between the adjacent lines of display electrodes may easily occur, but if the electrode occupy ratio is not more than about 0.7, the discharge is stable. If the electrode occupy ratio is not more than about 0.7, the minimum sustain voltage $V_{sm}$ is also stable. If the electrode occupy ratio is more than about 0.7, the minimum sustain voltage $V_{sm}$ is raised by discharge interference between adjacent lines L. Thus, a stable discharge operation or a wide operating margin can be obtained by selecting the electrode occupy ratio to be not more than about 0.7.

It is apparent that by eliminating barriers between adjacent unit luminescent areas defined along the extending direction of address electrodes, the effective display area and the brightness of the display can be improved and fabrication process becomes very easy.

Nevertheless, if the width of each of the display electrodes X and Y is less than about 20 μm, the electrodes tend to be broken and the electrode occupy ratio should preferably be not less than about 0.15.

Furthermore, in the embodiments of FIGS. 6 and 8, the discharge spaces are defined only by the barriers 29, in contrast to the embodiment of FIG. 7 where the discharge spaces are defined by the barriers 19 and 29 formed on both substrates 11 and 21. This permits the tolerance of the patterns of the barriers 29 to be enlarged significantly. For example, in the embodiment where the discharge spaces are defined by the barriers 19 and 29 formed on both substrates 11 and 21, if the unit luminescent area EU has a pitch of 220 μm, the tolerance of the patterns of each of the barriers 19 and 29 should be very severe, ± about 8 μm. In contrast, if the barriers 29 are made only on one side, the tolerance of the patterns thereof may be about some hundreds μm and the pattern alignment is significantly easily made and even a cheap glass substrate having significant shrinkage during firing may be used.

Figure 12A:
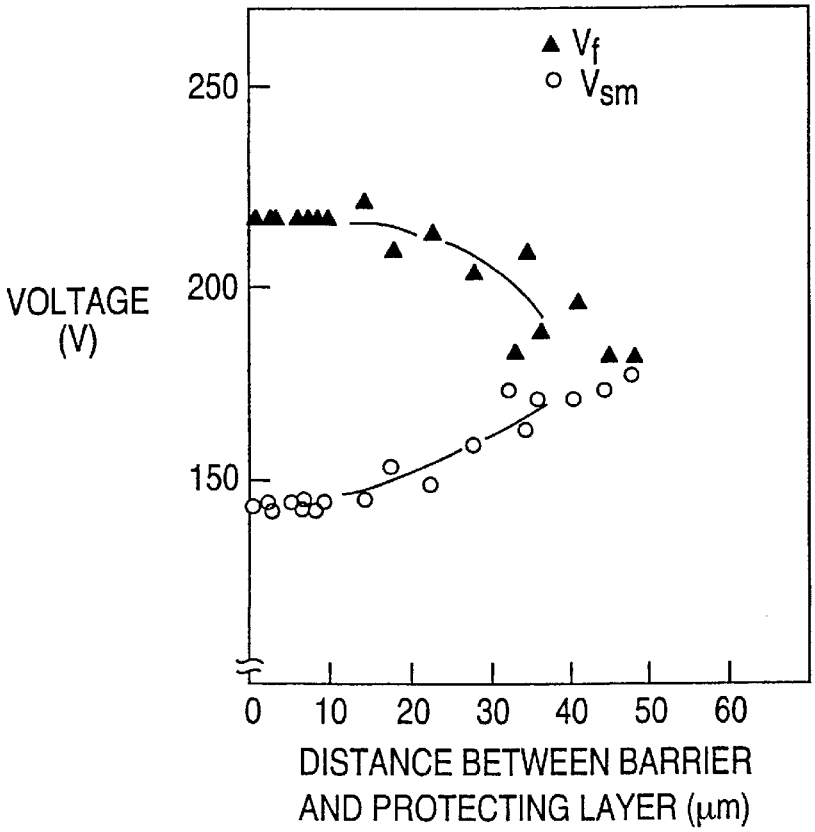
FIG. 12A is a second graph to illustrate how the stability of the discharge varies based on the structures of the barriers.
Figure 12B:
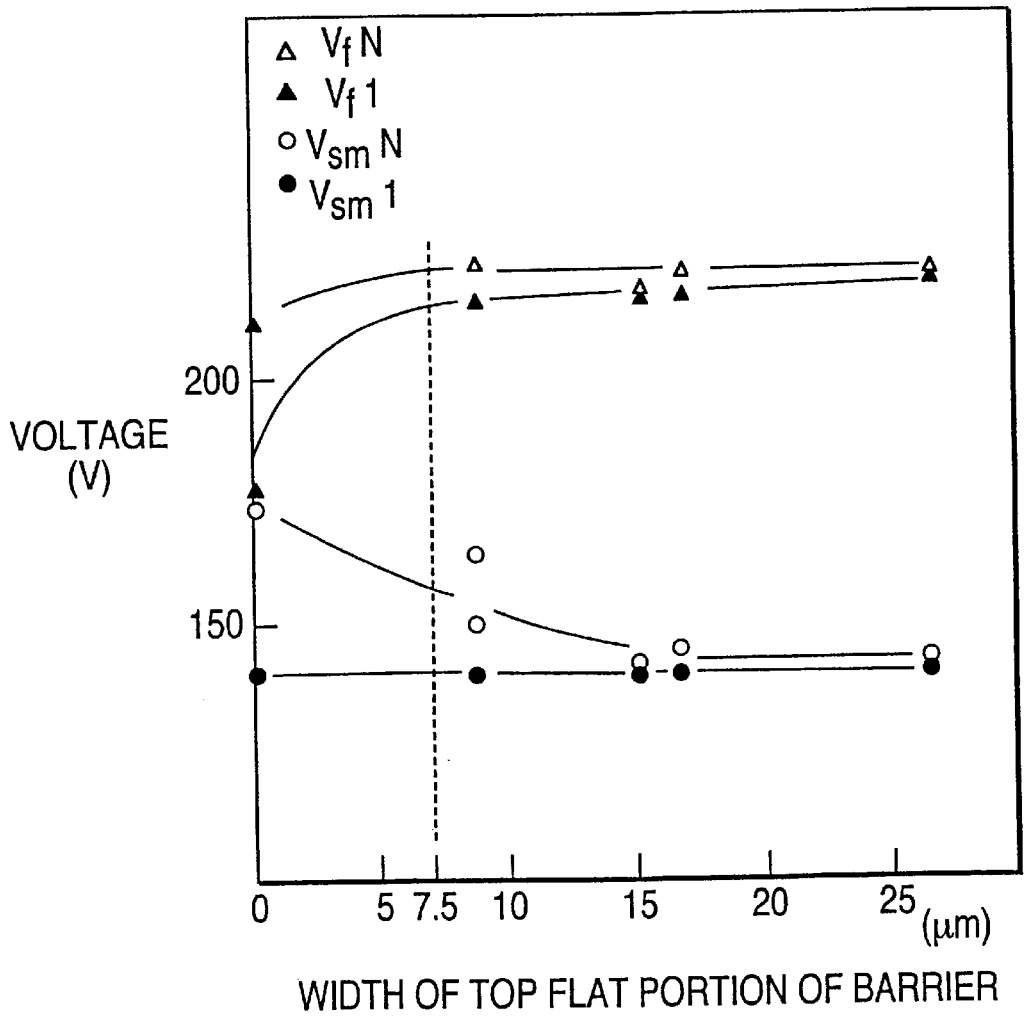
FIG. 12B is a third graph to illustrate how the stability of the discharge varies based on the structures of the barriers.

FIG. 12 shows the relationships between the firing voltage $V_f$ and, likewise, the minimum sustain voltage $V_{sm}$ and the distance between the top of the barriers 29 and the protecting layer 18 of the opposite side substrate 11. The distance between the top of the barriers 29 and the protecting layer 18 of the opposite side substrate 11 was determined by measuring the difference in the height of the barriers 29 by the depth of focus through a metallurgical microscope. In the measured panel, the barriers 29 had top portions having a width larger than 15 μm.

It is seen from FIG. 12 that if the distance between the top of the barriers 29 and the protecting layer 18 of the opposite side substrate 11 is more than 20 μm, it is difficult to obtain a wide margin. Accordingly, if the distance is not more than 20 μm, and preferably not more than 10 μm, a wide margin can be obtained. To attain this, it is preferred that the difference in height of the barriers be within ±5 μm.

Such a uniform height of barriers may be obtained by a method of forming a layer with a uniform thickness followed by etching or sand blasting the layer to form the barriers.

Figure 13:
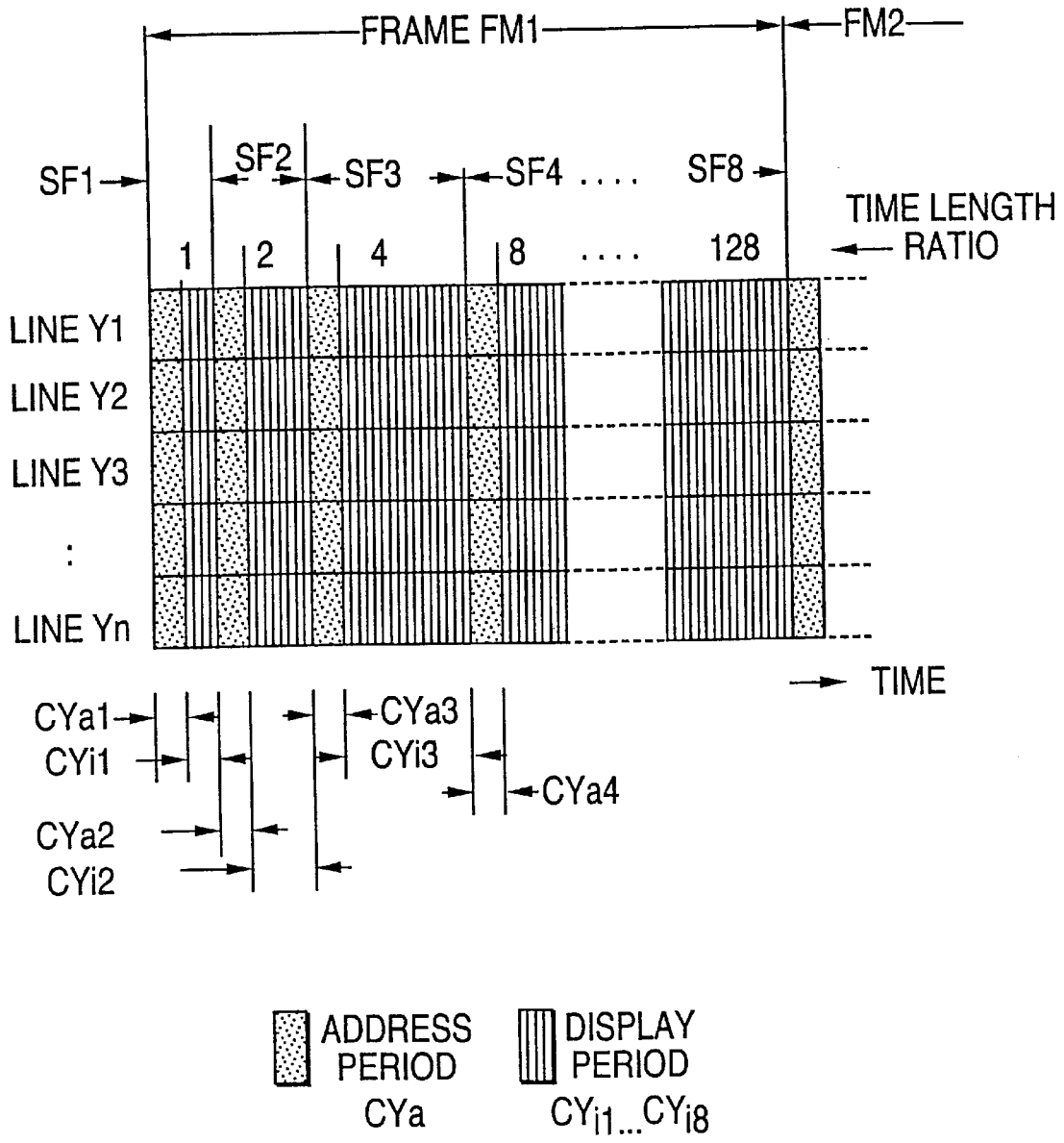
FIG. 13 illustrates a structure of a frame of the present invention.

Further, it was found that the top portions of the barriers should preferably be made flat. FIG. 13 shows the relationship between the firing voltage $V_f$ and minimum sustain voltage $V_{sm}$ and the width of the top flat portions of the barriers. The barriers having flat top portions were made by the above etching method. In FIG. 13, $V_f(N)$ represents the maximum firing voltage, $V_f(1)$ represents the minimum firing voltage, $V_{sm}(N)$ represents the maximum of the minimum sustain voltage, and $V_{sm}(1)$ represents the minimum of the minimum sustain voltage. As seen in FIG. 13, if the width of flat top portions of the barriers is not less than 7.5 μm, and more preferably not less than 15 μm, a wide margin can be obtained.

Such flat top portions of the barriers may be obtained by polishing the top portions of the barriers. This polishing also serves to obtain barriers with a uniform height.

In accordance with the present invention, the phosphor layers 28 are formed so as to cover the address electrodes 22 or A and side walls of the barriers so that the effective luminescent area is enlarged. In the conventional erase addressing method as shown in FIG. 3 for a panel as shown in FIG. 2C, electric charges on the phosphors or the insulators are not sufficiently cancelled or neutralized and erroneous addressing may occur. Accordingly, a drive method for successfully treating the electric charges is required.

FIG. 13 schematically illustrates a frame structure of a first preferred embodiment of a drive waveform for driving a panel in accordance with the present invention. A frame FM to drive a single picture on a flat display panel, such as a PDP or an electroluminescent panel, is formed of a plurality of, for example, eight subframes SF1 to SF8. Each subframe is formed of an address period CYa and one of display periods CYi1 . . . CYi8 subsequent to each address period CYa1 . . . CYa8. In each address period CYa, the cells to be lit are addressed by being written selectively from all the remaining cells of the panel. A practical operation in the address period CYa, according to the present invention, will be described later in detail. The display periods CYi1 to CYi8 have respective, different time lengths, essentially having a ratio 1:2:4:8:16:32:64:128, so that respective, different numbers of sustain pulses of same frequency are included, approximately in proportion to this ratio, in the display periods of the respective subframes. Visual brightness, i.e., the gradation of the brightness, of a lit cell is determined by the number of the sustain pulses accumulated for the single (i.e., individual) frame period. Thus, the gradation of 256 grades, defined by the 8 bits, can be determined for each cell by selectively operating one or a plurality of the eight subframes.

Figure 14:
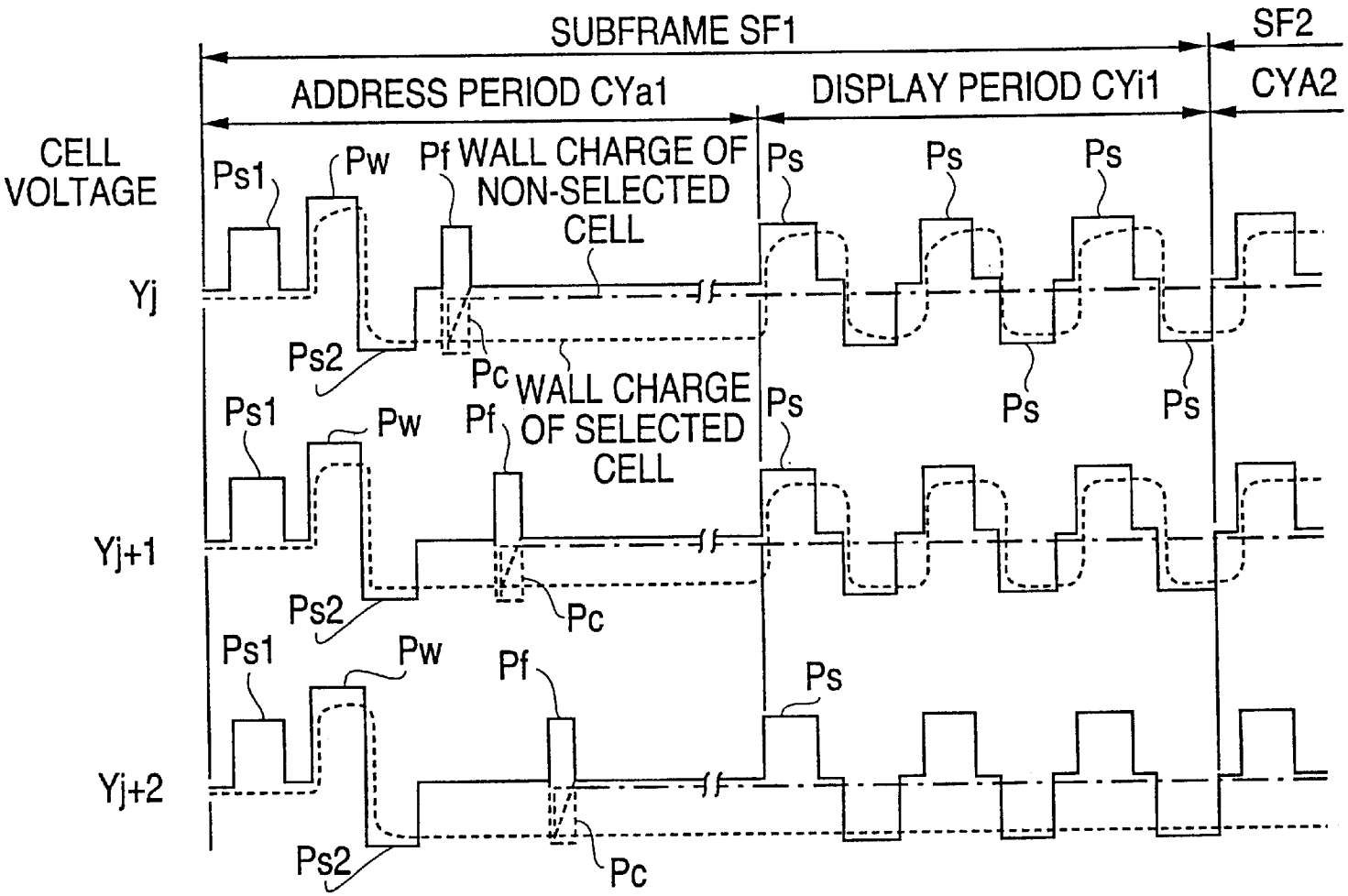
FIG. 14 illustrates waveforms of cell voltages applied across a cell on each line in a subframe.
Figure 16:
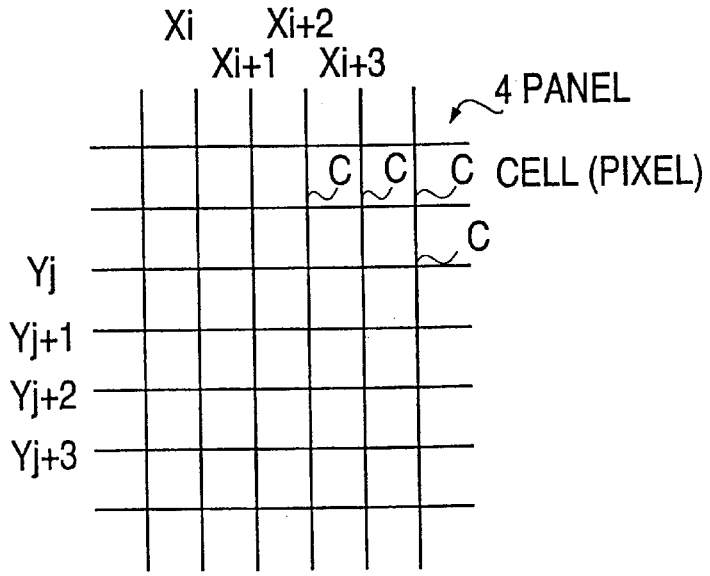
FIG. 16 schematically illustrates the structure of a flat display panel of an opposed-discharge type employed in the first preferred embodiment.

FIG. 14 shows voltage waveforms applied across the cells of an opposed-discharge type PDP of the invention, as hereinabove described, where a discharge takes place between matrix electrodes coated with insulating layers formed respectively on two glass panels facing each other. A layout of the matrix electrodes is schematically shown in FIG. 16; for the present explanation of the invention, the X-electrodes $X_f$, $X_{f-1}$, $X_{f-2}$ . . . are data electrodes and the Y-electrodes $Y_j$, $Y_{j+1}$, $Y_{j+2}$ . . . are scan electrodes. Cells C are formed at crossing points, or intersections, of the X-electrodes and the Y-electrodes.

Figure 15:
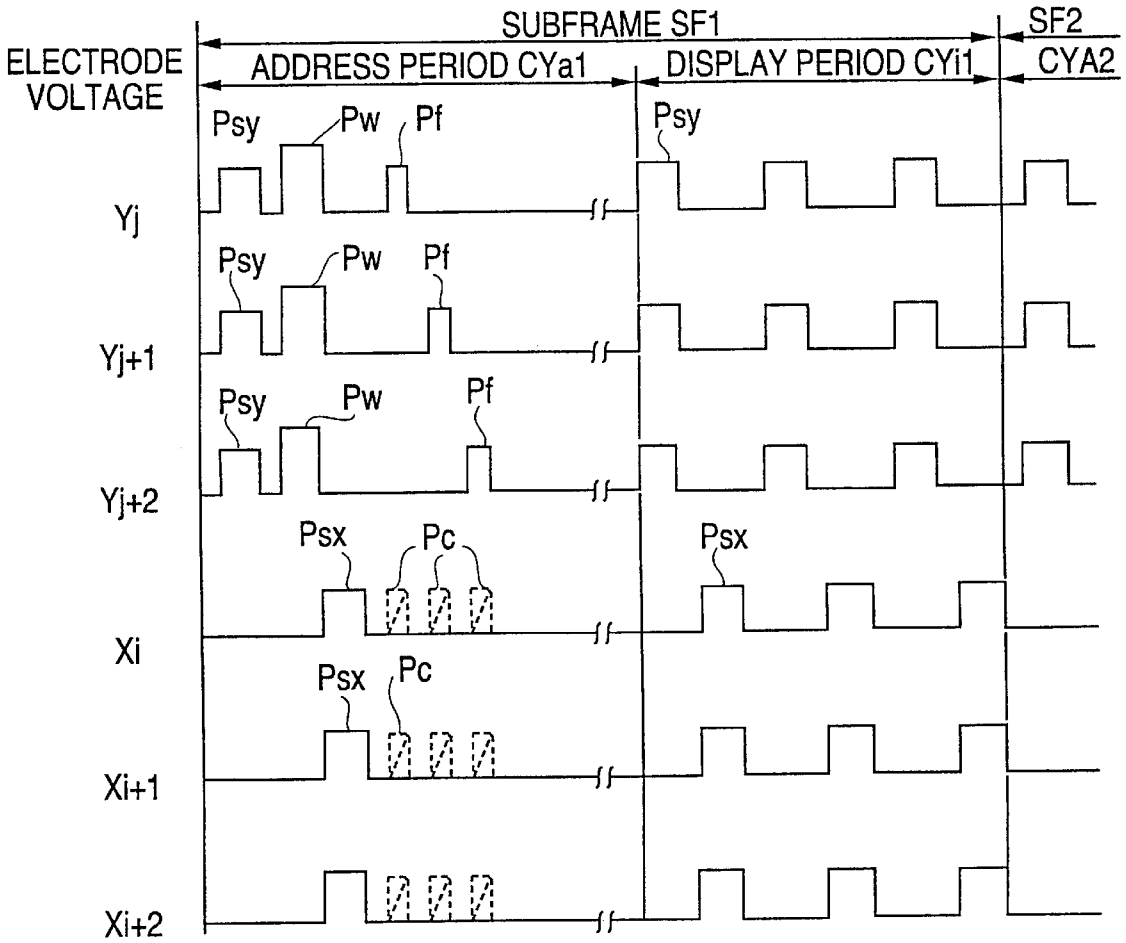
FIG. 15 illustrates voltage waveforms applied to Y-electrodes and X-electrodes, of a first preferred embodiment of the present invention.

Operation of the address period CYa is hereinafter described in detail. Voltage waveforms respectively applied to each of the X-electrodes and the Y-electrodes and producing the cell voltages of FIG. 14 are shown in FIG. 15. A sustain pulse Ps1 is applied to all the Y-electrodes in the same polarity as the subsequent write pulse; in other words, each sequence of sustain pulses ends at a sustain pulse having the polarity of the write pulse. Sustain pulses are typically 95 volt high and 5 μs long. Next, approximately 2 μs later, a write pulse Pw is applied to all the cells by applying a pulse Pw concurrently to all the Y-electrodes while the X-electrodes are kept at 0 volt; the write pulse Pw is typically 150 volt high and 5 μs long, adequate for both igniting a discharge as well as forming a wall charge (see FIG. 10), as a memory medium, in all the cells. Immediately subsequent to the write pulse Pw, a second sustain pulse Ps2 having a polarity opposite to that of the write pulse Pw is applied to all the cells by applying the sustain pulse voltage Psx to all the X-electrodes while the Y-electrodes are kept at 0 volt, in order to invert the wall charge by which the subsequent erase pulse Pf can be effective. Next, an erase pulse Pf, of typically 95 volt and 0.7 to 1 μs duration, is applied sequentially to each of the Y-electrodes; in other words, the Y-electrodes are scanned individually and in succession. Concurrently with the erase pulse application, a cancel pulse Pc having substantially the same level and the same width as the erase pulse Pf is selectively applied to an X-electrode connected to a cell to be lit, in order to cancel the function of the erase pulse Pf. Though a cell to which no cancel pulse is applied is lit once by the front edge of the erase pulse Pf, the pulse width is not sufficiently long so as to accumulate an adequate wall charge to provide the memory function. That is, the wall charge is erased so that the cell, so addressed, is not lit later. Thereby the writing operation, which has addressed the cells to be lit by cancelling the function of the erase pulse, is completed throughout the panel. Thus, the address period is approximately 621 μs long for a 400-line picture. If a sustain pulse Ps1 is not applied, in other words, if the display period ends at the sustain pulse having the polarity opposite to the write pulse, the change in the cell voltage upon the following application of the write pulse is equal to the sum of the voltage levels of the sustain pulse and the write pulse. This large change in the cell voltage may cause a deterioration of the insulation layers of the cell. Thus, the sustain pulse Ps1 is preferably introduced into the address period, but is not absolutely necessary. In each address cycle, all the cells are lit three (3) times, namely, by the sustain pulse Psy, the write pulse Pw and the erase pulse Pf; however, these three (3) lightings are negligible compared with the far larger number of cell lightings produced in the display cycles.

A first display period CYi1, provided subsequently to the first address period CYa1, is approximately 46 μs long. The sustain pulses are typically 5 μs wide and typically have a 2 μs interval therebetween; therefore, three pairs of the sustain pulses of frequency 71.4 kHz are included in the first display period CYi1. The sustain pulses are applied to all the cells by applying the sustain pulse voltage Psy, in a current phase, to all the Y-electrodes and, in the next phase, by applying the sustain pulse voltage Psx to all the X-electrodes. Then, the cells which were addressed, i.e., having the wall charge, in the first address period CYa1 are lit by the sustain pulses in the subsequent display period CYi1 of subframe SF1. The first subframe SF1 is now completed.

In the second address period CYa2 of the second subframe SF2, subsequent to the first display period CYi1, the cells to be lit during the second display period CYi2 are addressed in the same way as the first address period. The second display period CYi2, subsequent to the second address period CYa2, is approximately 91 μs long, so as to contain 6 pairs of sustain pulses.

In the further subsequent subframes SF3 . . . SF8, the operations are the same as those of the first and second subframes SF1 and SF2; however, the time length, or duration, and the number of the sustain pulses contained therein are varied as calculated below:

a frame period of 60 frames per second: 16,666 ms;

address period as described above: 621 μs;

total time length occupied by address periods of 8 subframes: 621×8=4,968 μs;

time length allowed for 8 display periods: 16,666−4,968=11,698 μs;

time length to be allocated to a minimum unit of 256 grades (represented by 8 bits): 11,698/256=45.67 μs;

time length TL of each display period of other subframes;

TL=45.67×2, 4, 8, 16, 32, 64 and 128 μs, respectively; accordingly:

| display period time length: | | number of sustain pulse pairs: |
|---|---|---|
| 1st SF | approx. 45 μs | approx. 3 |
| 2nd SF | 91 | 6 |
| 3rd SF | 182 | 13 |
| 4th SF | 365 | 26 |
| 5th SF | 730 | 52 |
| 6th SF | 1,461 | 104 |
| 7th SF | 2,924 | 209 |
| 8th SF | 5,845 | 418 |
| | | total 831 |

frequency of sustain pulses having a 14 μs period: 1/14 μs=71.4 kHz

Accordingly, a total number of sustain pulse pairs in each second is 831×60=49,860, which is sufficient to provide the brightness of the maximum gradation.

Though, in the above preferred embodiment, the respective time periods, or directions, of the display periods are different to provide different numbers of sustain pulses, the display periods may be allocated constantly to each subframe, for example: 11,698 μs/8=1,462 μs, during which respective, different numbers of the sustain pulses are contained. For varying the sustain pulse numbers, the frequency may be varied for each subframe, such as 0.75, 1.5, 3, 6, 12, 24, 48 and 96 kHz, where the numbers of the sustain pulse pairs are 1, 2, 4, 8, 17, n35, 70 and 140, respectively. In the constant time length 1,4624 μs of the display periods, sustain pulses may be of a constant frequency, such as 96 kHz, where unnecessary pulses are killed (i.e., deleted, or blanked) so as to leave a necessary number of sustain pulses in each display period.

Figure 18:
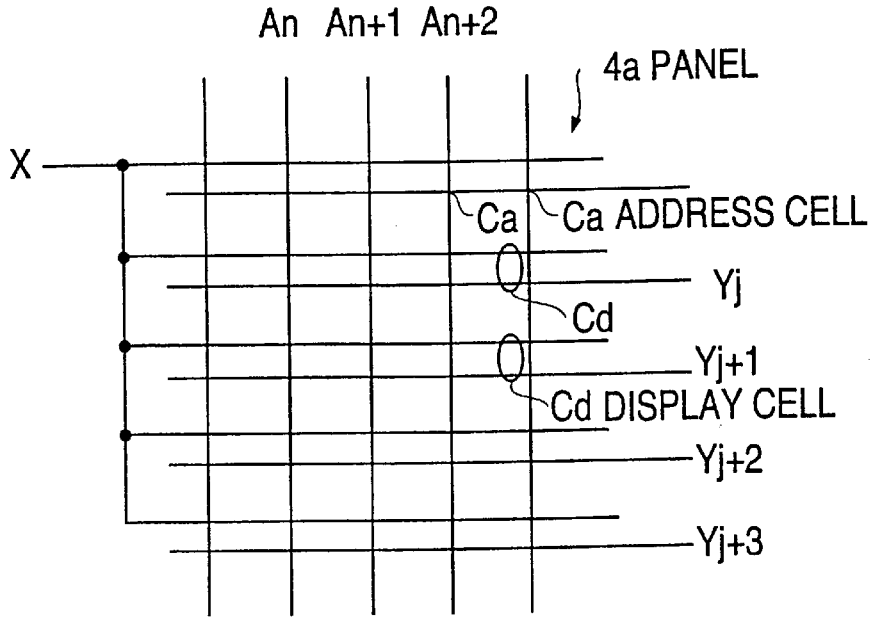
FIG. 18 schematically illustrates the structure of a flat display panel of a surface discharge type employed in the second preferred embodiment.
Figure 17:
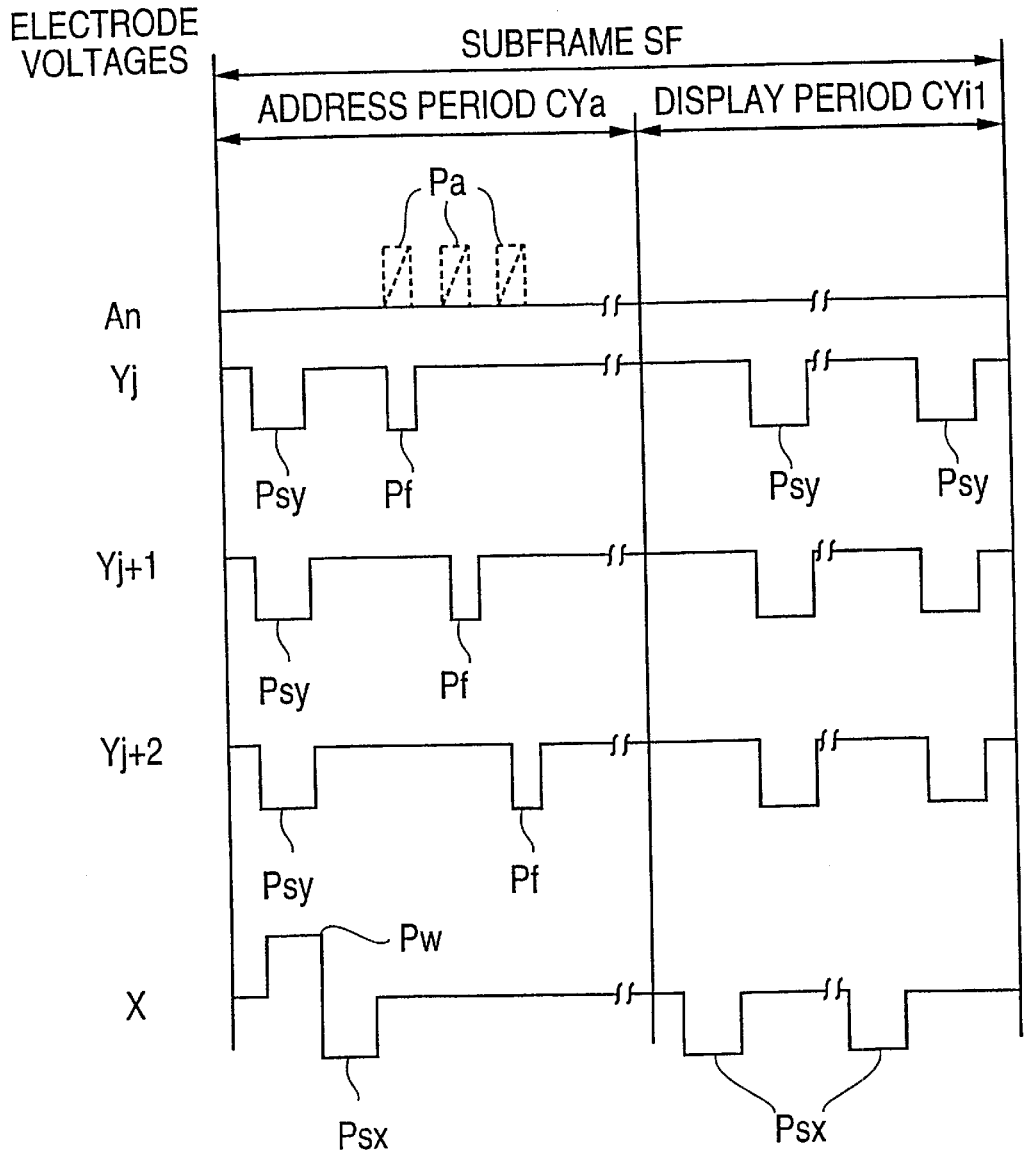
FIG. 17 illustrates respective voltage waveforms applied to Y-electrodes and X-electrodes, of a second preferred embodiment.

A second preferred embodiment of the present invention, applied to a surface discharge type PDP, is hereinafter described. The surface discharge type PDP may be of the widely known type disclosed in Japanese Unexamined Patent Publication Tokukai Sho 57-78751 and 61-39341, or schematically illustrated in FIG. 18. A plurality of X-electrodes X, parallel to and positioned close to respective ones of a plurality of Y-electrodes $Y_j$, $Y_{j-1}$, $Y_{j-2}$ . . . , and plural address electrodes An, An+1, An+2, . . . orthogonal to the X and Y electrodes, are arranged on a surface of a panel. Electrodes crossing each other are insulated with an insulating layer. An address cell Ca is formed at each of the crossed points of the Y-electrodes $Y_j$, $Y_{j+1}$, $Y_{j+2}$ and the address electrodes An, An+1, An+2, . . . Display cells Cd are formed between the adjacent, associated Y-electrode and X-electrode, close to the corresponding address cells Ca, respectively. Voltage waveforms applied to the X-electrodes X, the Y-electrodes $Y_j$, $Y_{j+1}$, $Y_{j+2}$, . . . , and the address electrode An are shown in FIG. 17. An address period CYa is performed concurrently with respect to all the Y-electrodes. In each address period, a write pulse Pw, typically 5 μs long and 90 volt high, is applied to all the X-electrodes while a first sustain pulse Psy1, that is opposite in polarity to the write pulse Pw and typically 5 μs long and 150 volt high, is applied to all the Y-electrodes, and the address electrodes are kept at 0 volt. Accordingly, all the display cells Cd are discharged by the summed cell voltage 240 V=90 V+150 V. Next, immediately subsequently to the write pulse, a second sustain pulse Psx, typically 5 μs long and 150 volt high and of an opposite polarity to the write pulse Pw, is applied to all the X-electrodes, so that a wall charge is generated in each display cell Cd and in a part of the associated address cell Ca.

Next, an erase pulse Pf, typically 150 volt high and 3μ long, is applied sequentially to each of the Y-electrodes in the same manner as the first preferred embodiment. Concurrently to the erase pulse application, an address pulse Pa, typically 90 volt high and 3μ long, is selectively applied to an address-electrode of a display cell Cd which is not to be lit later in the subsequent display period CYi1 and thus in the same way as that of the first preferred embodiment, whereby the wall charge is erased. At a cell to which no address pulse is applied, the wall charge is maintained. Thus, the cells to be lit later are addressed, throughout the panel, by maintaining the wall charge in the selected cells.

In a first display period CYi1 subsequent to the first address period CYa1, sustain pulses, typically 150 volt high and 5 μs long, are applied to all the cells by applying sustain pulses Psy to all the Y-electrodes and sustain pulses Psx alternately to all the X-electrodes. The cells having been addressed to have the wall charge are lit by the sustain pulsed. In the subsequent subframes the same operations are repeated as those of the first subframe, except that the respective time lengths of the display periods are different in each subframe, as the same way as that of the first preferred embodiment. The time length allocated to each subframe is identical to that of the first preferred embodiment. Accordingly, the same advantageous effects can be accomplished in the second embodiment, as well.

Though in the above preferred embodiments the time length allocation is done in such a manner that the first subframe has the shortest display period and the last subframe has the longest display period, it is apparent that the order of the time length allocation is arbitrarily chosen.

Figure 19:
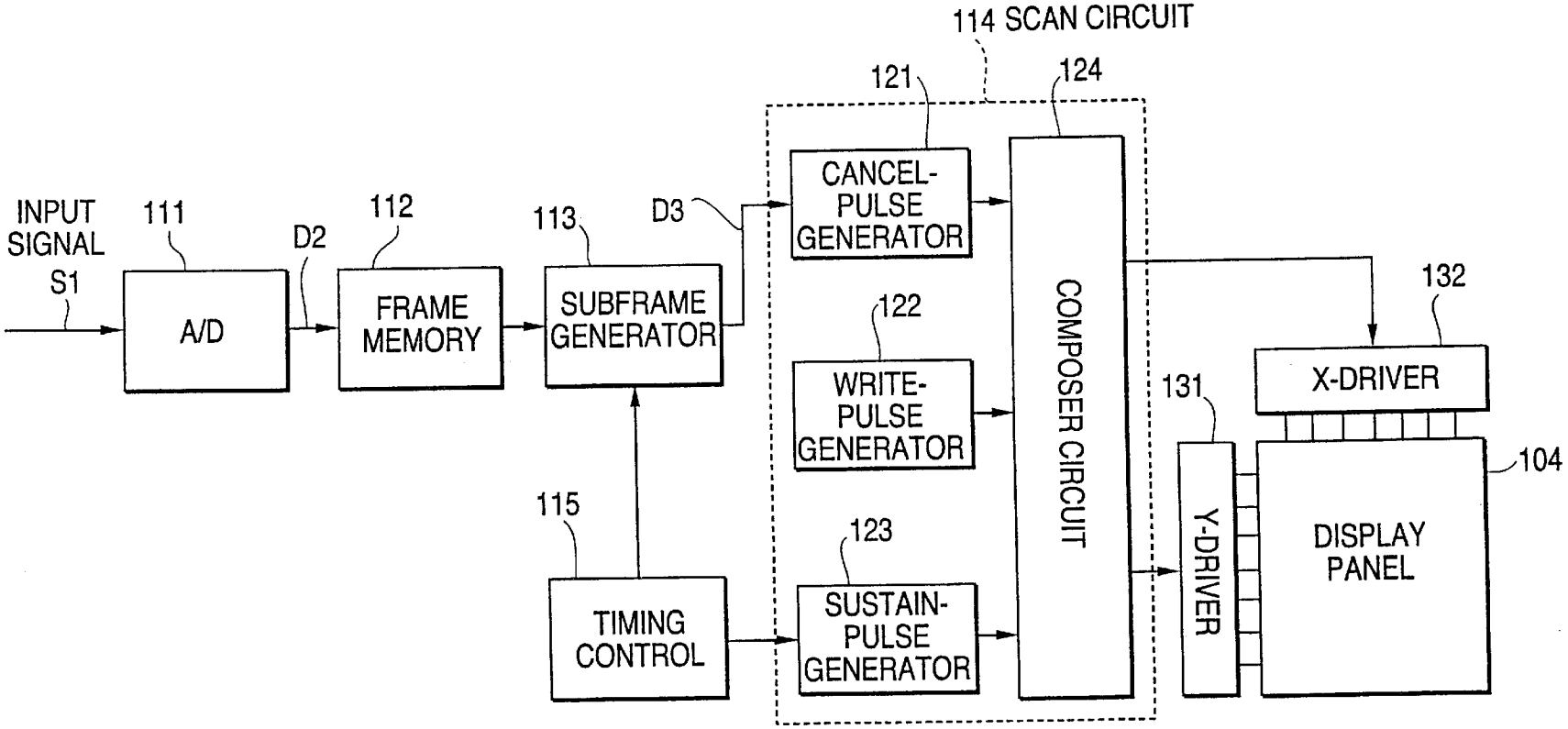
FIG. 19 schematically illustrates a block diagram of a driving circuit configuration according to the present invention.

FIG. 19 shows a block diagram of a driving circuit of the present invention for providing gradation of the visual brightness of a flat matrix panel are disclosed hereinabove. An analog input signal S1, of picture data to be displayed, is converted by an A/D converter 111 to a digital signal D2. A frame memory 112 stores the digital signal D2 of a single frame FM output from A/D converter 111. A subframe generator 113 divides a single frame of picture data D2 stored in the frame memory 112 into plural subframes SF1, SF2 . . . according to the required gradation level, so as to output respective subframe data D3. A scanning circuit 114 scans a Y-electrode driver 131 and an X-electrode driver 132 of the display panel 104. The scanning circuit 114 comprises a cancel pulse generator 121 to generate the cancel pulses Pc of the first preferred embodiment as well as the address pulses Pa of the second preferred embodiment; a write pulse generator 122 to generate the write pulses Pw; a sustain pulse generator 123 to generate the sustain pulses Ps; and a composer (i.e., combiner) circuit 124 to compose, or combine, these signals. A timing controller 115 outputs several kinds of timing signals for timing functions, such as process timing of subframe generator 113, output timing of the cancel pulse generator, and termination timing of the display period, in each subframe.

Operation of the gradation drive circuit is hereinafter described. The waveforms applied to the panel are the same as those already described above. In the case where the picture data, each of whose pixels has n bit picture data, is stored in frame memory 112 so that the picture is displayed by a $2^n$ level brightness gradation, subframe generator (processor) 113 sequentially outputs n kinds of binary data D3, i.e., pixel position data identifying the position of each pixel to be selected, or turned ON, in each subframe, of a picture to be exclusively formed of the respective gradation bits for each pixel, in the order from the least significant bit to the most significant bit and thus from the brightness data of the lowest level but to the brightness data of the highest level bit. Accordingly, the subframe processor (generator) 113 reads the data D3 of an identical bit order from the n bit brightness data for each pixel, to make a subframe image of the above, identical bit order. Depending on this picture data D3, the cancel pulse generator 121 outputs cancel pulses Pc, at the moment when a line is selected, to X-electrodes connected to the cells to be addressed, and thus to be lighted, on this selected Y-electrode. Timing controller 115 outputs a timing control signal so that the time length of each display period of subframes becomes a predetermined length in accordance with picture data D3 for the pixel position data output from subframe processor (generator) 113. Composer (combiner) circuit 124 outputs the scan voltages shown in FIG. 15 by combining the respective pulse signals output from the pulse generators 121, 122 and 123 so that the address period CYa and the display period CYi can be executed in each subframe SF.

Figure 1A:
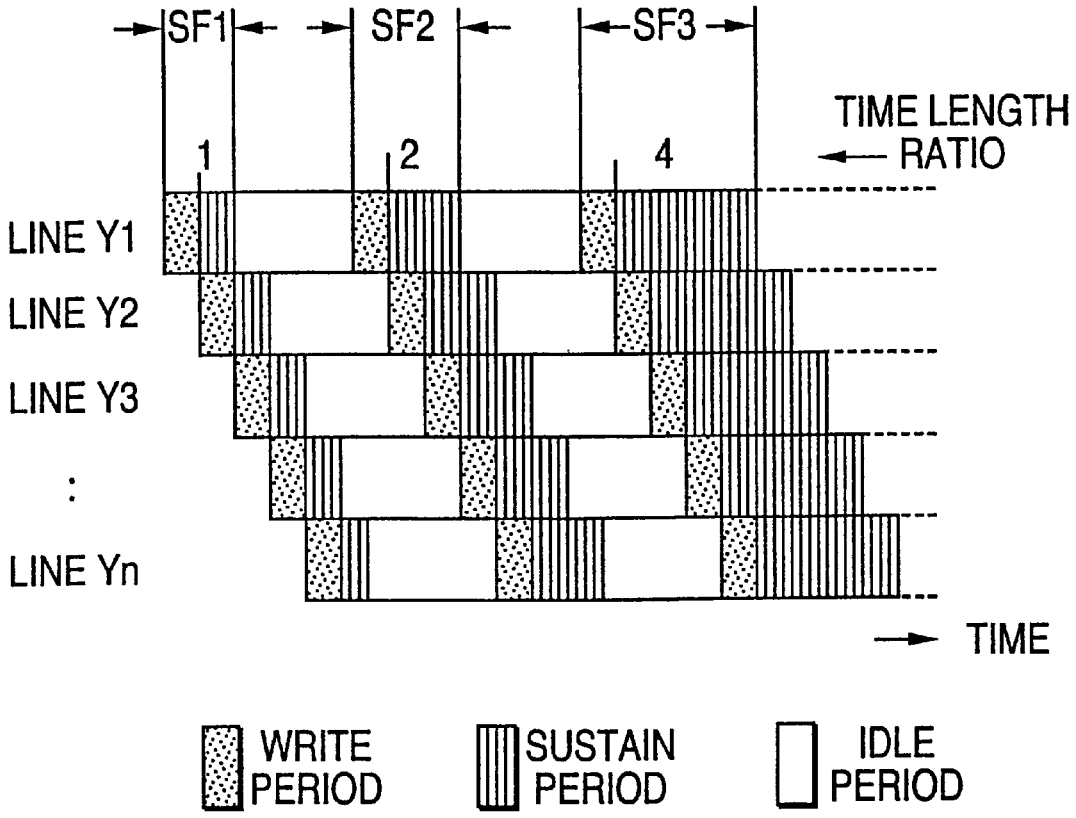
FIG. 1A (PRIOR ART)
FIG. 1A schematically illustrates a prior art structure of a frame of a driving waveform for driving each line of a matrix display panel.
Figure 1B:
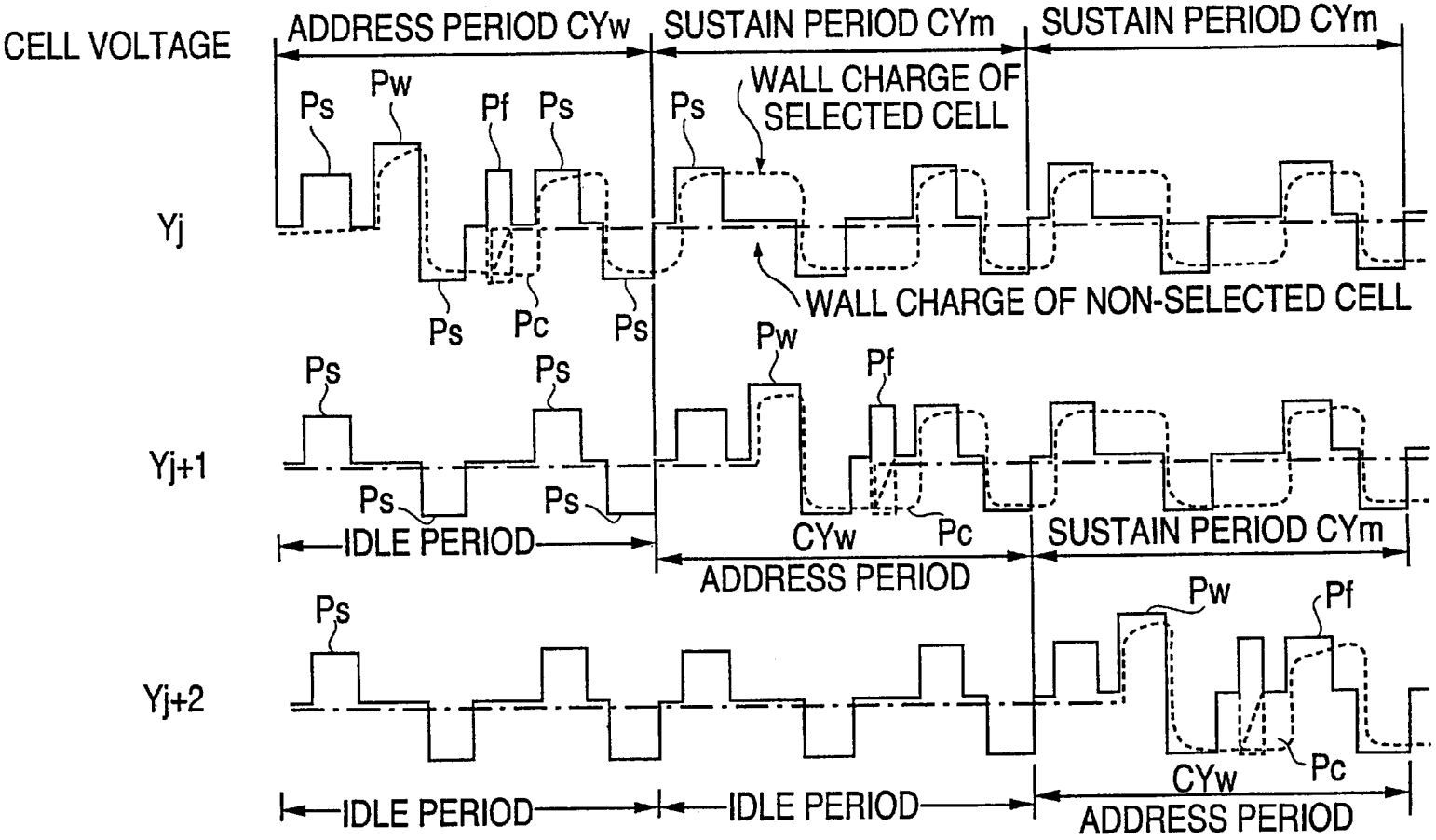
FIG. 1B (PRIOR ART)
FIG. 1B schematically illustrates waveforms in the prior art frames.
Figure 1C:
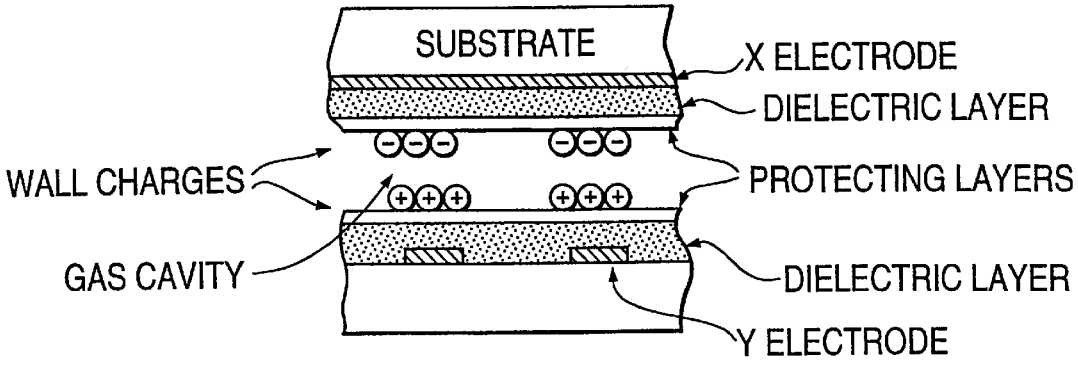
FIG. 1C (PRIOR ART)
FIG. 1C shows a wall charge.
Figure 1D:
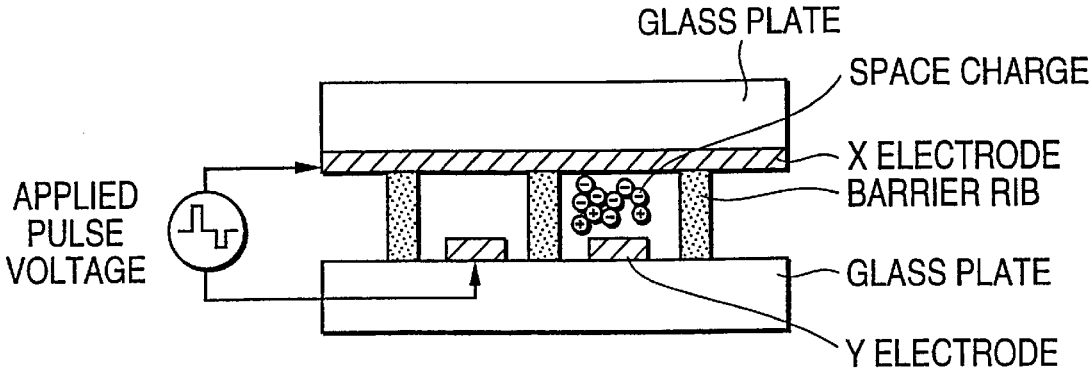
FIG. 1D (PRIOR ART)
FIG. 1D shows a space charge.

In the first and second preferred embodiments, the erase/cancel pulses may be as short, or brief, as 1 μs and may require only 600 μs for addressing the cells to be lit on the 400 lines after the concurrent application of the write pulse to all the cells. Thus, the amount of time required for the addressing operation is drastically decreased, compared with the FIG. 1A prior art method wherein the duration of the write pulses Pw, i.e., as long as 5 μs, occupy about 2.2 ms for individually addressing the 400 lines. As a result, the time for the display periods may be as large as 11.7 ms, which is enough to provide a 256-grade gradation.

Accordingly, the driving frequency can be lowered in accomplishing the same gradation level. The lower driving frequency lowers the power consumption in the driving circuit, as well as allows a longer pulse width, which provides more margin in the operation reliability.

Moreover, the method of the present invention solves the prior art problem in that the driving circuit configuration is complicated, because the write period CYw of a line must be executed concurrently to the sustain period CYm of the other lines, accordingly, the pulses must be of very high frequency.

Furthermore, in the present invention, the number of sustain pulses in each subframe can be easily chosen because the display period CY1 is completely independent of the address period CYa, since the cycle of the sustain pulses does not need to synchronize with the cycle of the address cycle.

Owing to the above-described advantages afforded by the driving method and circuit of the present invention, the gradation can be easily controlled, the ratio of the respective time duration of the display periods in the subframes can be arbitrarily and easily chosen so that the gradation can meet the gamma characteristics of human eyes and, accordingly, the present invention is advantageous in affording freedom in designing the circuit, the production cost and the product reliability, as well.

Though in the address period, of the above preferred embodiments, the addressing operation is carried out by canceling the once-written cells, it is apparent that the addressing method may be of other conventional methods wherein the writing operation is carried out only on the cells to be lit, without "writing-all" and "erasing-some-of-them." Even in this case, the same advantageous effect can be achieved as in the above preferred embodiments.

The full color display can be attained by performing the above operation to each of the three primary color luminescent areas EU. The graded display can be attained by adequately selecting the number of the surface discharge during respective divided periods.

In the above embodiments, the discharge can be stabilized even when the phosphor layers 128 are formed to cover the address electrodes A or 122 and thus improvement of the brightness of display and the viewing angle can be attained. The results are shown in FIGS. 9 and 10.

The many features and advantages of the invention are apparent from the foregoing detailed description and, thus, it is intended by the appended claims to cover all such features and advantages of the panel structure and driving methods and circuits which fall within the true spirit and scope of the invention.

What is claimed is:

1. A color image display system, comprising:

a plasma display panel operable for displaying a color image of selectable brightness gradations and comprising:

a first substrate having a first main surface, plural elongated barrier ribs disposed on the first main surface, extending in a first direction and spaced in a second, different direction, pairs of adjacent barrier ribs defining corresponding elongated cavities therebetween, plural address electrodes respectively disposed within the plural elongated cavities, each address electrode being positioned between the adjacent barrier ribs of a corresponding pair thereof and extending throughout a length of the respective cavity, plural sets of color phosphor strips, each set comprising a common number of plural phosphor strips of respective, different colors received in a respective set of a corresponding number of adjacent cavities, each color phosphorous strip extending substantially continuously throughout the length of the corresponding cavity, a second substrate disposed on the first substrate and having a second main surface spaced from the first main surface, and plural pairs of display electrodes disposed on the second main surface and extending in the second direction, each pair of display electrodes crossing the plural address electrodes and defining, in association with each phosphor strip and respective address electrode, a respective sub-pixel and, in association with each set of color phosphor strips and respective set of addresses electrodes, a set of sub-pixels comprising a pixel of the display panel; and a driving system producing a driving waveform for driving said plasma display panel in accordance with color image data defining successive color images to be displayed in respective, successive image frames, the color image data of each image frame defining, for the associated set of sub-pixels of each pixel, respective relative brightness gradation levels and the driving waveform for each image frame comprising plural, successive subframe driving waveforms producing selectable, respective brightness gradation level increments, the driving system, in individual succession for the plural subframes of each image frame and respectively in successive address and drive periods of each subframe, selectively addressing and thereby selecting individual sub-pixels to be driven and commonly driving the selected sub-pixels for producing, as respective outputs thereof, the common brightness gradation level increment of the corresponding subframe and such that the composite of the respective increment outputs of each sub-pixel, selectively produced for the plural subframes of each image frame, corresponds to the respective relative brightness gradation level thereof for the image frame, as defined by the color image data.

2. A color image display system as recited in claim 1, wherein the driving system further comprises:

a pulse generator unit selectively generating write, erase and cancel pulses; and a controller and timing unit defining a common duration of the respective address periods of the plural subframes of each frame and, in each address period, concurrently applying a write pulse in common to all of the sub-pixels through a first electrode of the respective display electrode pairs and, subsequently, in successive addressing intervals of the address period, individually addressing the sub-pixels and establishing wall charges at the selected sub-pixels by selective application of addressing pulses thereto, through the address electrodes and the second display electrodes of the pairs of display electrodes respectively associated with the selected sub-pixels, thereby to select the sub-pixels to be driven in the subsequent drive period of the respective subframe.

3. A color image display system as recited in claim 2, wherein the timing and control unit individually addresses the sub-pixels in accordance with:

applying erase pulses selectively to the respective second electrodes of the plural pairs of display electrodes, each erase pulse being effective to remove the wall charge at the corresponding sub-pixel; and concurrently with each of the erase pulses and in common for the respective sub-pixels of a corresponding display electrode pair, selectively applying cancel pulses to the respective address electrodes corresponding to the selected sub-pixels thereby to cancel the effect of the erase pulse and maintain the wall charge, at each selected sub-pixel, in individual succession for the plural display electrode pairs and respectively corresponding sub-pixels.

4. A color image display system as recited in claim 3, wherein the drive system further comprises:

a sustain pulse generator producing successive sustain pulses; and the controller and timing unit, further, defining corresponding, different durations of the respective display periods of the plural subframes of each image frame and applying corresponding and respective, different numbers of sustain pulses, in common, to the plural sub-pixels during the respective display periods thereby to produce respective, different gradation level increments of the corresponding subframes.

5. A color image display system as recited in claim 1, wherein the brightness gradation level increments are of plural different relative brightness gradation levels.

6. A color image display system, comprising:

a surface discharge type plasma display panel comprising a first substrate, parallel address electrodes and respective continuous phosphor stripes arranged within corresponding elongated cavities on a first main surface thereof and extending in a first direction thereon, the phosphor strips being arranged in successive sets, each set of successive different colors, and a second substrate having a second main surface positioned in opposed, parallel relationship to the first main surface of the first substrate and having plural pairs of display electrodes disposed thereon and extending in a second direction, transverse to the first direction, crossing portions of the respectively associated address electrodes and phosphor strips defining plural sub-pixels and a set of sub-pixels of successive different color phosphor strip portions comprising a pixel of the display panel; and a driving system producing a driving waveform for driving said plasma display panel in accordance with color image data defining successive color images to be displayed in respective, successive image frames, the color image data of each image frame defining, for the associated set of sub-pixels of each pixel, respective relative brightness gradation levels and the driving waveform for each image frame comprising plural, successive subframe driving waveforms producing selectable, respective brightness gradation level increments and all sub-pixels having a common such increment in an individual, common subframe, and wherein the driving system, in individual succession for the plural subframes of each image frame, in an address period of each subframe, selectively addresses and thereby selects sub-pixels and, in a subsequent driving period of the subframe, drives the selected sub-pixels so as to produce, as a composite of the respective increment outputs of the sub-pixels for the plural subframes of each image frame, the respective relative brightness gradation levels for the sub-pixels as defined by the image data.

7. A color image display system as recited in claim 6, wherein each sub-pixel, as defined by corresponding, crossing portions of a respective address electrode and of a respective pair of first and second display electrodes, further comprises an address cell extending in a third direction, transverse to the first and second directions, between the corresponding crossing portions of the respective address electrode and the first display electrode of the respective pair thereof and a display cell extending in the first direction between the corresponding portions of the first and second display electrodes of the respective pair thereof, each subframe driving waveform having, in time succession, an address period and a drive period, and wherein the driving system, in the address period, selectively establishes discharges in the address cells thereby to maintain corresponding discharges in the associated display cell of each selected sub-pixel and, in the display period, concurrently applies sustain pulses to the first and second display electrodes of all of the pairs of display electrodes to sustain discharges in the discharge cells of the selected sub-pixels.

8. A color image display system as recited in claim 6, wherein the driving system further comprises:

a write pulse generator generating a write pulse in an initial time interval of each address period, applied in common to all of the first display electrodes of the plural pairs of display electrodes;

an erase pulse generator generating erase pulses applied in successive time intervals and in individual succession to the second display electrodes of the plural pairs of display electrodes thereby to erase wall charges developed in the display cells respectively associated with each display electrode pair;

a cancel pulse generator producing plural cancel pulses applied respectively and selectively to the plural address electrodes in the successive time intervals of the erase pulses and operative to cancel the effect of the concurrent erase pulse on the address cell of each selected sub-pixel;

first and second sustain pulse generators generating first sustain pulses and second sustain pulses for application to the first and second electrodes, respectively, of each of the plural pairs of display electrodes; and a control circuit controlling the timing and application of the write, erase and cancel pulses during the address period and for controlling the application of the sustain pulses during the subsequent display period, of each subframe.

9. A color image display system as recited in claim 8, wherein the respective address periods of the plural subframes of each image frame are of a common duration and the respective display periods of the plural subframes of each image frame are of respective, different durations, the sustain pulse generator producing sustain pulses of fixed pulse width and a fixed frequency and the control circuit altering the duration of the display periods, and correspondingly the respective number of sustain pulses in the corresponding display periods of different durations, in accordance with providing respective and different gradation level increments of the plural subframes.

10. A color image display system as recited in claim 6, wherein the respective brightness gradation level increments are mutually different relative brightness gradation levels.

11. A method of driving a color image display panel, the panel comprising a first substrate having a first main surface, plural elongated barrier ribs disposed on the first main surface, extending in a first direction and spaced in a second, different direction, pairs of adjacent barrier ribs defining corresponding elongated cavities therebetween, plural address electrodes respectively disposed within the plural elongated cavities, each address electrode being positioned between the adjacent barrier ribs of a corresponding pair thereof and extending throughout a length of the respective cavity, plural sets of color phosphor strips, each set comprising a common number of plural phosphor strips of respective, different colors received in a respective set of a corresponding number of adjacent cavities, each color phosphorous strip extending substantially continuously throughout the length of the corresponding cavity, a second substrate disposed on the first substrate and having a second main surface spaced from the first main surface, and plural pairs of display electrodes disposed on the second main surface and extending in the second direction, each pair of display electrodes crossing the plural address electrodes and defining, in association with each phosphor strip and respective address electrode, a respective sub-pixel and, in association with each set of color phosphor strips and respective set of addresses electrodes, a set of sub-pixels comprising a pixel of the display panel, and the driving method comprising:

defining a driving waveform for driving the plasma display panel to display thereon successive color images in respective, successive image frames in accordance with successive frames of color image data, the color image data for each image frame defining respective relative brightness gradation levels for each pixel and correspondingly for the respective, associated set of sub-pixels, the driving waveform for each image frame comprising plural, successive subframe driving waveforms producing selectable, respective brightness gradation level increments, all sub-pixels having a common such increment in a given subframe, the respective gradation level increments of the plural subframes being selectively combinable so as to produce a plurality of composites of the brightness gradation level increments corresponding to the relative brightness gradation levels defined by the color image data; and in individual succession for the plural subframes of each image frame and respectively in successive address and drive periods of each subframe, addressing and thereby selecting the sub-pixels and commonly driving the selected sub-pixels for producing, as respective outputs thereof, the common brightness gradation level increment of the corresponding subframe and such that the composite of the respective increment outputs, of each sub-pixel for the plural subframes of each image frame, corresponds to the respective relative brightness gradation level thereof for the image frame defined by the color image data.

12. A method as recited in claim 11, further comprising:

(a) driving the panel, in each subframe of the plural subframes of an image frame, by:

(i) selectively addressing and thereby selecting all sub-pixels for which the relative brightness level increment of the corresponding subframe is to be combined to produce the composite brightness gradation level corresponding to the gradation level defined by the image data for the respective sub-pixels, and (ii) commonly driving the selected sub-pixels to produce, from each thereof, the common relative brightness gradation level increment of the given subframe; and (b) repeating steps (a)(i) and a(ii), in individual succession for the plural subframes of each image frame.

13. A method as recited in claim 11, wherein the brightness gradation level increments are of plural different relative brightness gradation levels.

14. A method of addressing a plasma display panel having a matrix of discharge cells defined at intersections of plural rows, defined by corresponding plural display electrodes formed on a first substrate, and plural columns, defined by corresponding plural address electrodes formed on a second substrate, each address electrode and a respective phosphor strip of a continuous length, common to all discharge cells of the corresponding column, being disposed between a corresponding pair of barrier ribs, the address electrodes and the display electrodes being covered by respective insulating layers and separated by a discharge space, for producing displays of successive color images in respective, successive image frames in accordance with color image data defining, for each cell, respective relative brightness gradation levels, the method comprising:

defining a driving waveform for each image frame comprising plural, successive subframe driving waveforms producing selectable, respective brightness gradation level increments of the discharge cells, all discharge cells having a common brightness gradation level increment in each subframe;

defining, in each subframe, an address period and a subsequent, associated display period;

determining, for each discharge cell, a selected set of active subframes in which the discharge cell is discharged, of the plural subframes of each image frame, and for which active subframes the respective gradation level increments, in the composite, correspond to the brightness gradation level of the discharge cell as specified by the image display data; and in the address period of each subframe, initially addressing all of the discharge cells of the panel and selecting, for discharge, those cells for which the corresponding subframe is an active subframe and in the subsequent, associated display period of the subframe, commonly driving all of the selected cells so as to produce, for each cell in each image frame, the brightness gradation level thereof as specified by the image display data.

15. A method as recited in claim 14, wherein the respective address periods of the plural subframes of each image frame have a common duration and the respective drive periods thereof have respective, different durations corresponding to respective, different brightness gradation level increments thereof.

16. A method as recited in claim 14, wherein:

the step of addressing the panel further comprises addressing all cells of an individual row concurrently, and in succession for the plural rows, in the address period of each subframe; and the driving step further comprises driving all selected cells concurrently in the subsequent, associated drive period of each subframe.

17. A method as recited in claim 14, wherein the plasma display panel produces color images in accordance with color image data and the phosphor strips are arranged in sets of plural phosphor strips, each set comprising successive, plural and different colors, adjacent discharge cells corresponding to respective portions of adjacent phosphor strips of a set thereof comprising respective sub-pixels and each set of sub-pixels comprising a pixel of the color image.

18. A method as recited in claim 14, wherein the brightness gradation level increments are of plural different relative brightness gradation levels.

19. A method of driving a matrix display panel of first and second substrates having respective, first and second main surfaces in parallel and opposed relationship, parallel address electrodes and respective continuous phosphor stripes being arranged within corresponding elongated cavities extending in a first direction on the first main surface and display electrodes being formed on the second main surface and extending in a second direction, transverse to the first direction and crossing the color phosphor stripes and defining thereby corresponding pixels, each display electrode defining a line of pixels in the second direction and each of said pixels having a memory function, said method comprising the steps of:

dividing a period of a frame, displaying a single picture, into a plurality of subframes, the plurality of lines of pixels being concurrently activated in each subframe and each subframe including:

an addressing period for addressing a pixel by selectively forming a memory medium according to said memory function in a selected one of the pixels on each sequentially selected one of all the lines, and a display period, subsequent to said addressing period, for lighting said addressed pixel by a concurrent application of sustain pulses to all the pixels, each subframe being allocated with a predetermined number of said sustain pulses so as to weight a gradation to said respective subframe; and determining a gradation of a visual brightness of said lit pixel by selectively operating each said subframe for each of said pixels for each frame.

20. A method of driving a matrix display as recited in claim 19, further comprising establishing respective, different penetrated numbers of said sustain pulses for the plurality of subframes in each frame.

21. A color image display system, comprising:

a surface discharge type plasma display panel comprising:

first and second substrates having respective, first and second main surfaces in parallel, opposed relationship, parallel address electrodes and respective continuous phosphor stripes being arranged within corresponding elongated cavities extending in a first direction on the first main surface and display electrodes being formed on the second main surface and extending in a second direction, transverse to the first direction and crossing the color phosphor stripes and defining thereby corresponding pixels, each display electrode defining a line of pixels in the second direction; and a driving system comprising:

a timing circuit dividing, with time, a single frame to be displayed on the panel into a plurality of subframes wherein the plural lines are concurrently activated in each subframe, a driving circuit selectively operating said subframes for each of said pixels, said driving circuit forming a memory medium according to said memory function in said pixels during each address period and lighting said pixels having said memory medium formed therein during a display period by concurrently applying sustain pulses to all pixels, subsequently to said address period, each subframe including a predetermined number of sustain pulses in each display period, wherein the gradation of visual brightness of the pixel is determined by accumulation of time lengths of display periods of said selectively operated subframes through said single frame.

22. A color image display system as recited in claim 21, wherein each subframe includes respective, different predetermined numbers of sustain pulses in the respective subframes of each frame.

23. A method of driving a matrix display panel of first and second substrates having respective, first and second main surfaces in parallel, opposed relationship, parallel address electrodes and respective continuous phosphor stripes being arranged within corresponding elongated cavities extending in a first direction on the first main surface and display electrodes being formed on the second main surface and extending in a second direction, transverse to the first direction and crossing the color phosphor stripes and defining thereby corresponding pixels, each display electrode defining a line of pixels in the second direction and, each pixel being capable of having a charge accumulated therein, said method comprising the steps of:

dividing a period of a frame displaying a single picture into a plurality of subframes wherein lines are concurrently activated in each subframe, each subframe including:

an addressing period in which a pixel to be selected is addressed by applying a write pulse concurrently to all the pixels and applying an erase pulse sequentially to each unselected one of the pixels, and a display period in which said selected pixels are lighted by concurrently applying sustain pulses to all the pixels, each subframe being allocated with a predetermined number of said sustain pulses so as to weight a gradation to said respective subframe; and determining a gradation of visual brightness of each said lighted pixel by selectively operating said subframe for each of said pixels for each frame.

24. A method of driving a matrix display panel, of first and second substrates having respective, first and second main surfaces in parallel, opposed relationship, parallel address electrodes and respective continuous phosphor stripes being arranged within corresponding elongated cavities extending in a first direction on the first main surface and display electrodes being formed on the second main surface and extending in a second direction, transverse to the first direction and crossing the color phosphor stripes and defining thereby corresponding pixels, each display electrode defining a line of pixels in the second direction and, each pixel being capable of having a charge accumulated therein, said method comprising the steps of:

dividing a period of a frame displaying a single picture into a plurality of subframes wherein lines are concurrently activated in each subframe, each subframe including:

an addressing period for addressing a pixel by selectively applying a write pulse to each selected one of the pixels, the write pulse forming a memory medium in a selected one of all the pixels, and a display period for lighting said addressed pixel by a concurrent application of sustain pulses to all the pixels, each subframe being allocated with a predetermined number of the sustain pulses so as to weight a gradation to said respective subframe, wherein a gradation of visual brightness of the lit pixel is determined by selectively operating the subframe for each of the pixels for each frame.

25. A method of driving a matrix display panel of first and second substrates having respective, first and second main surfaces in parallel, opposed relationship, parallel address electrodes and respective continuous phosphor stripes being arranged within corresponding elongated cavities extending in a first direction on the first main surface and display electrodes being formed on the second main surface and extending in a second direction, transverse to the first direction and crossing the color phosphor stripes and defining thereby corresponding pixels, each display electrode defining a line of pixels in the second direction and, each of said pixels being capable of storing display data by having a charge remaining therein, said method comprising the steps of:

dividing a period of a frame displaying a single picture into a plurality of subframes, each subframe including:

an addressing period for addressing a pixel by selectively forming said charge in a selected one of the pixels on each sequentially selected one of all the lines, and a display period, subsequent to said address period, for lighting said addressed pixel by a concurrent application of sustain pulses to all the pixels, each subframe being allocated with a predetermined number of said sustain pulses, so as to weight a gradation to said respective subframe, said address period and display period of each subframe respectively being concurrent to all the lines in the single picture; and determining a gradation of visual brightness of said lit pixel by selectively operating each said subframe for each of said pixels for each frame.

26. A method of driving a surface discharge type plasma display panel including:

a plurality of address electrode; and a plurality of pairs of parallel and adjacent first (Y) and second (X) electrodes, for respectively defining a plurality of display lines;

wherein said first and second display electrodes are orthogonal to said address electrodes, address cells are formed at points where the first display electrodes cross said address electrode; display cells are formed between each pair of first and second display electrodes in a vicinity of respective associated address cells, and a display cell together with the associated address cell in its vicinity constitute a pixel of the matrix display; and a selected pixel is addressed during an address period by forming a wall charge at said selected pixel and the selected pixel is lit up during the display period by application of sustain pulses to said selected pixel via the corresponding pair of first and second display electrodes;

said method comprising the steps of:

dividing period of a frame displaying a single picture into a plurality of subframes, each subframe having a concurrent addressing period and a concurrent display period for all display lines, said addressing period concurrent to all of said display lines of said single picture, for addressing a pixel by selectively forming a memory medium according to said memory function in a selected one of the pixels on each sequentially selected one of all the display lines;

said display period, subsequent to said addressing period, for lighting said addressed pixel by a concurrent application of sustain pulses to all the pixels, each subframe being allocated with a predetermined number of said sustain pulses, and each subframe including a different one of said allocated numbers so as to weight a gradation to said respective subframe, wherein a gradation of visual brightness of said lit pixel is determined by selectively operating said subframe for each of said pixels for each frame.

27. A system for displaying a color image, with a selective gradation of brightness, comprising:

a plasma display panel comprising a first substrate having a main surface and plural elongating barrier ribs disposed generally transversely on the main surface and extending in a first direction along the main surface and spaced in a second direction, different from the first direction and defining a corresponding plurality of elongated cavities therebetween;

plural address electrodes, each disposed between a pair of adjacent barriers and extending within and through a length of the corresponding cavity, plural sets of color phosphor strips, each set comprising a common number of plural phosphor strips of respective, different colors received in a respective set of plural, adjacent cavities, each color phosphorous stripe extending continuously, substantially throughout the length of the corresponding cavity, and a second substrate, disposed on the first substrate, having plural pairs of display electrodes thereon extending in the second direction relative to the first direction of the barrier ribs and cavities and associated address electrodes, each pair of display electrodes crossing the plural address electrode and defining, with each address electrode, a respective sub-pixel; and said system comprising:

a divider circuit dividing, with time, a single frame of the color image to be displayed on the panel into a plurality of subframes, and a selection circuit selectively operating said subframes for all of said sub-pixels, said selection circuit selectively addressing said sub-pixels during an address period provided concurrently for all said sub-pixels, and a driver circuit lighting said addressed sub-pixels during a display period by concurrently applying sustain pulses to all sub-pixels subsequently to said address period, each subframe including a predetermined number of sustain pulses in each display period, and the gradation of visual brightness of the sub-pixels being determined by an accumulation of time lengths of respective display periods of said selectively operated subframes through said single frame, thereby to display said color image.

28. A system for displaying a color image with a gradation of brightness on a plasma display panel as recited in claim 27, wherein said selection circuit further comprises a write pulse generator generating and applying a write pulse concurrently to all the sub-pixels through said pairs of display electrodes, and an erase pulse generator applying erase pulses sequentially to selected sub-pixels through a selected individual electrode of the display electrode pair and sequentially selected address electrodes.

29. A system for displaying a color image with a gradation of brightness on a plasma display panel as recited in claim 28, wherein said selection circuit further comprising a write pulse generator generating and applying a write pulse concurrently to all the sub-pixels through said pairs of display electrodes, an erase pulse generator applying an erase pulse concurrently to all said once fired sub-pixels by said write pulse, through said pairs of display electrodes, and a circuit applying write pulses sequentially to selected sub-pixels through a selected individual electrode of the display electrode pair and sequentially selected address electrodes.

30. A system for displaying a color image with a gradation of brightness on a plasma display panel as recited in claim 28, wherein said selection circuit further comprises a scanning circuit scanning the pairs of display electrodes by applying a scanning signal to a selected individual electrode of each of said display electrode pairs, sequentially for all of said display electrode pairs.

31. A system for displaying a color image with a gradation of brightness on a plasma display panel as recited in claim 29, wherein said selection circuit further comprises a scanning circuit scanning the pairs of display electrodes by applying a scanning signal to a selected individual electrode of each of said display electrode pairs, sequentially for all of said display electrode pairs.

32. A system for displaying a color image with a gradation of brightness on a plasma display panel as recited in claim 30, wherein said selection circuit further comprises a scanning circuit scanning the pairs of display electrodes by applying a scanning signal to a selected individual electrode of each of said display electrode pairs, sequentially for all of said display electrode pairs.

33. A method for displaying a full color picture with a gradation of brightness on a surface discharge plasma display device, said surface discharge plasma display device comprising:

first and second substrates parallel to each other and defining a space therebetween in which a discharge gas is filled;

a plurality of display electrode pairs, corresponding to display lines, formed on the first substrate and facing the second substrate, the display electrodes of each pair being parallel to each other and constituting an electrode pair for surface discharge;

a dielectric layer over the display electrodes and the first substrate;

a plurality of address electrodes formed on the second substrate, facing the first substrate and running in a direction intersecting the pairs of display electrodes;

a plurality of phosphor layers formed on the second substrate in a linear stripe pattern along respective address electrodes, said phosphor layers comprising three primary color phosphor layers, arranged successively and repeatedly in the longitudinal direction of said display lines, said three adjacent primary color phosphor portions on each of said display lines constituting a single image element and each single image element comprising a unit of three addressable primary color sub-pixels;

said method comprising the steps of:

dividing a period of a frame displaying a single full color picture into a plurality of subframes, wherein all of said display lines are concurrently activated in each subframe, each subframe including:

an address period in which said sub-pixels are addressed by applying an address signal to selected ones of the sub-pixels on each sequentially selected one of the display lines, and a display period, subsequent to said addressing period, in which each addressed sub-pixel is lighted concurrently applying sustain pulses to all sub-pixels, each subframe being allocated with a predetermined number of said sustain pulses so as to weight a gradation to said respective subframe; and displaying said color picture with a gradation of visual brightness by selectively operating each of said three primary color sub-pixels in each subframe of each said frame.

34. A method for displaying a full color picture with gradation of visual brightness on a surface discharge plasma display device, as recited in claim 33, further comprising, in each said address period of each subframe, applying a write signal to all of said sub-pixels through said display electrode pairs, and selectively applying erase signals to sub-pixels not to be displayed through a selected individual display electrode of each of said electrode pairs, in line by line sequence, and selected address electrodes.

35. A method for displaying a full color picture with gradation of visual brightness on a surface discharge plasma display device, as recited in claim 33, further comprising, in each said address period of each subframe, applying a write signal to all of said sub-pixels through said display electrode pairs, applying an erase signal to all of said once discharged sub-pixels through said display electrode pairs, and applying a write signal to sub-pixels, based on the color picture, through a selected one of the display electrodes of each of said electrode pairs, in line by line sequence, and selected address electrodes.

36. A method for displaying a full color picture with gradation of visual brightness on a surface discharge plasma display device, as recited in claim 33, further comprising, each of said subframes:

sequentially applying a scanning signal to a selected electrode of each of said display electrode pairs so as to select the display line;

applying the address signal to selected ones of the address electrodes coincidentally with said scanning signal so as to select the sub-pixels on the selected display line, for said address period; and commonly applying the sustain pulses between all of said display electrode pairs so as to produce the display period.

37. A color image display system, comprising:

a plasma display panel operable for displaying a color image of selectable brightness gradations and comprising first and second substrates having respective first and second main surfaces in parallel, opposed relationship, parallel address electrodes and respective continuous phosphor stripes being arranged within corresponding elongated cavities on the first main surface and extending in a first direction, display electrodes being formed on the second main surface, extending in a second direction transverse to the first direction and crossing the address electrodes and respective phosphor stripes, each display electrode defining a display line of pixels in the second direction; and a driving system driving the matrix display panel in accordance with color image data defining successive color images to be displayed in respective, successive image frames, the color image data of each image frame defining respective relative brightness gradation levels of the image frames, the driving system dividing a period of a frame displaying a single picture into a plurality of subframes wherein lines are concurrently activated in each subframe, each subframe including:

an addressing period for addressing a pixel by selectively applying a write pulse to each selected one of the pixels, the write pulse forming a memory medium in a selected one of all the pixels, and a display period for lighting said addressed pixel by a concurrent application of sustain pulses to all the pixels, each subframe being allocated with a predetermined number of the sustain pulses so as to weight a gradation to said respective subframe, wherein a gradation of visual brightness of the lit pixel is determined by selectively operating the subframe for each of the pixels for each frame.

* * * * *